US008176596B2

(12) United States Patent
Conrad

(10) Patent No.: US 8,176,596 B2
(45) Date of Patent: May 15, 2012

(54) VACUUM CLEANER

(75) Inventor: Wayne Ernest Conrad, Hampton (CA)

(73) Assignee: G.B.D. Corp., Nassau (BS)

( * ) Notice: Subject to any disclaimer, the term of this patent is extended or adjusted under 35 U.S.C. 154(b) by 1164 days.

(21) Appl. No.: 11/954,137

(22) Filed: Dec. 11, 2007

(65) Prior Publication Data

US 2008/0196195 A1 Aug. 21, 2008

Related U.S. Application Data

(60) Provisional application No. 60/894,005, filed on Mar. 9, 2007, provisional application No. 60/869,586, filed on Dec. 12, 2006.

(51) Int. Cl.
*A47L 9/16* (2006.01)

(52) U.S. Cl. ..... 15/347; 15/353; 55/337; 55/424; 55/426; 55/DIG. 3; 55/427

(58) Field of Classification Search ..... 15/347–353; 55/426, 337, 345, 346, 424, 428, 429, DIG. 3, 55/427; *A47L 9/16*
See application file for complete search history.

(56) References Cited

U.S. PATENT DOCUMENTS

| | | | | |
|---|---|---|---|---|
| 3,320,727 | A | 5/1967 | Farley et al. | |
| 6,481,049 | B1 | 11/2002 | Berfield | |
| 7,857,878 | B2 * | 12/2010 | Park et al. | 55/337 |
| 2005/0198770 | A1 * | 9/2005 | Jung et al. | 15/353 |
| 2005/0252180 | A1 | 11/2005 | Oh et al. | |

* cited by examiner

*Primary Examiner* — David Redding
(74) *Attorney, Agent, or Firm* — Bereskin & Parr LLP/S.E.N.C.R.L., s.r.l

(57) ABSTRACT

Several alternate improvements of a vacuum cleaner are provided. In one aspect, the vacuum cleaner utilizes interchangeable components. In another aspect, the vacuum cleaner comprises a chamber having a top, and a first cleaning stage and suction motor are provided on the top. In another aspect, the vacuum cleaner utilizes a reconfigurable divider plate.

11 Claims, 24 Drawing Sheets

VACUUM CLEANER

CROSS REFERENCES TO RELATED APPLICATIONS

This application claims priority from U.S. Provisional Patent Application 60/894,005 (filed on Mar. 9, 2007) and 60/869,586, filed on Dec. 12, 2006, which are incorporated herein by reference in their entirety.

FIELD OF THE INVENTION

This invention relates to surface cleaning apparatus such as vacuum cleaners, wet/dry vacuum cleaner and carpet extractors. In one aspect, the surface cleaning apparatus comprises a chamber having a top, and a first cleaning stage and suction motor are provided on the top. In one aspect, the surface cleaning apparatus utilizes interchangeable components. In another aspect, the surface cleaning apparatus utilizes a reconfigurable divider plate. These aspects may be used individually or in any possible combination or sub-combination.

BACKGROUND OF THE INVENTION

Known vacuum cleaners are designed for collecting a particular particle size range of dirt. For example, a household vacuum cleaner is typically designed for collecting particulate matter that accumulates on hardwood floors and carpet. Current household vacuum cleaners that utilize cyclonic separation will tend to become clogged if the vacuum cleaner is used to collect, e.g., ash from a fireplace or dry wall dust. Such particulate matter is lighter and finer than common household dust and a substantial portion of this material will pass through a current cyclonic vacuum cleaner and will be collected by a filter positioned downstream from the cyclone. Similarly, wet/dry vacuum cleaners may be utilized to collect saw dust or other construction debris. However, additional filters may be inserted in the air stream in the wet/dry vacuum cleaner if the wet/dry vacuum cleaner is to collect, e.g., dry wall dust. Accordingly, even though a wet/dry vacuum cleaner may be adapted to collect dry wall dust by the addition of filters, it requires the vacuum cleaner being disassembled and addition filtration members manually inserted.

In addition, current wet/dry or shop vac style vacuum cleaners are large bulk appliances, which are cumbersome to ship and store.

SUMMARY OF THE INVENTION

In accordance with one aspect of the present invention a surface cleaning apparatus, such as a wet/dry or canister vacuum cleaner, is provided which has at least some, and preferably all, of the operating components of the surface cleaning apparatus attached to the top of the collection chamber. Accordingly, the collection chamber may comprise the mount or base for the operating components. An advantage of this design is that the fewer structure elements may be required, thereby permitting a simplified construction of the surface cleaning apparatus and reduced weight of the surface cleaning apparatus.

In a preferred embodiment, the operating components may be mounted on the upper surface of the top (i.e. not in the collection chamber). Preferably, the operating components are positionable in the collection bin, such as by being removably mounted to the top and/or the top being removably mounted to the collection chamber. In such a latter embodiment, the top may be removed and inverted prior to being placed on the collection chamber, thereby placing the operating components in the collection chamber. This configuration is advantageous as the surface cleaning apparatus may be shipped in a carton having reduced size.

Accordingly, in a first broad aspect, the surface cleaning apparatus may comprise a member having a dirty fluid inlet. A fluid flow path extends from the dirty fluid inlet to a clean air outlet of the surface cleaning apparatus. The apparatus further comprises a separated material chamber having a top. A first cleaning stage and a suction motor provided on the top.

In some embodiments, the top is openable.

In some embodiments, the top is removably mounted to the separated material chamber.

In some embodiments, the first cleaning stage comprises a cyclonic cleaning stage.

In some embodiments, the apparatus further comprises a second cyclonic cleaning stage. In further embodiments, the first cleaning stage, the second cyclonic cleaning stage and the suction motor and arranged linearly on the top.

In some embodiments, the first cleaning stage and the suction motor and arranged linearly on the top.

In some embodiments, the top has an outer surface and the first cleaning stage and the suction motor and provided on the outer surface.

In some embodiments, the first cleaning stage and the suction motor and insertable into the separated material chamber. In some such embodiments, the separated material chamber has a depth and the first cleaning stage and the suction motor have a maximum height and the maximum height is less then the depth.

In some embodiments, at least one of the first cleaning stage and the suction motor are removably mounted to the top.

In some embodiments, the apparatus further comprises at least one of an alternate cleaning stage that is interchangeable with the first cleaning stage and an alternate suction motor that is interchangeable with the suction motor.

In some embodiments, at least one of the first cleaning stage and the suction motor are removably mounted to the top. In further embodiments, the apparatus comprises at least one of an alternate cleaning stage that is interchangeable with the first cleaning stage and an alternate suction motor that is interchangeable with the suction motor.

In accordance with another aspect, a kit for a surface cleaning apparatus is provided. In accordance with this aspect, a surface cleaning apparatus may be sold with one or more interchangeable operating components, or one or more interchangeable operating components may be available for purchase separately. For example, different cyclonic stages may be interchangeably connectable to the surface cleaning apparatus. For example, a surface cleaning apparatus may be sold with one or more collection stages designed to collect normal household dirt. An interchangeable cleaning stage or stages may be available that are designed to collect, e.g., finer particulate matter, such as fireplace ash or dry wall dust. Accordingly, instead of having to insert a filter, a user may merely remove, e.g. one cyclone chamber (e.g., which may be removably mounted by a bayonet mount) and insert a different cyclone chamber.

Accordingly, in accordance with this second broad aspect, the kit may comprise a member having a dirty fluid inlet. A fluid flow path extends from the dirty fluid inlet to a clean air outlet of the surface cleaning apparatus, and includes a plurality of operating components. The operating components include a first cyclonic cleaning unit and a first suction motor. At least one additional component is interchangeable with another operating component.

In some embodiments, the additional component comprises a second cyclonic cleaning unit that is interchangeable with the first cyclonic cleaning unit. In further embodiments, the first and second cyclonic cleaning units are configured to separate material having a different average particle size.

In some embodiments, the second cyclonic cleaning unit comprises two cyclonic stages and the first cyclonic cleaning unit has one cyclonic cleaning stage.

In some embodiments, the additional component comprises a second suction motor that is interchangeable with the first suction motor.

In some embodiments, the second suction motor has a higher amperage rating then the first suction motor.

In accordance with a third aspect, a surface cleaning apparatus surface cleaning apparatus may be provided which has at least one cyclonic cleaning stage having a divider plate at a transition between a cyclone chamber and a collection chamber. The divider plate is reconfigurable to change the separation efficiency for different types of particulate matter. For example, the position of the divider plate may be altered, the shape of the divider plate may be altered and/or the divider plate may be removably mounted so that an alternate divider plate may be inserted. For example, a divider plate in one configuration may be designed to collect normal household dirt. In an alternate configuration, the divider plate may be designed to collect, e.g., finer particulate matter, such as fireplace ash or dry wall dust. Accordingly, instead of having to insert a filter, a user may merely reconfigure the divider plate.

In accordance with this third broad aspect, a surface cleaning apparatus is provided. The surface cleaning apparatus comprises a member having a dirty fluid inlet. A fluid flow path extends from the dirty fluid inlet to a clean air outlet of the surface cleaning apparatus and includes a suction motor. At least one cyclone is positioned in the fluid flow path and has at least one material outlet. A reconfigurable divider plate is associated with the material outlet.

In some embodiments, the divider plate is replaceable with an alternate divider plate.

In some embodiments, the divider plate has a configuration that is variable. In some such embodiments, the configuration of the divider plate is variable from a planar configuration to a bow shaped configuration.

In some embodiments, the divider plate has a portion that is removable. In some such embodiments, the removable portion comprises a central section of the divider plate.

In some embodiments, the divider plate has a portion that is movable. In some such embodiments, the movable portion comprises a central section of the divider plate.

In some embodiments, the divider plate is moveable with respect to a separated material outlet of the cyclone. In further embodiments, the divider plate is moveable towards the separated material outlet. In other embodiments, the divider plate is moveable laterally with respect to the separated material outlet.

BRIEF DESCRIPTION OF THE DRAWINGS

These and other advantages of the instant invention will be more fully and completely understood in accordance with the following drawings of the preferred embodiments of the vacuum cleaner in which.

DETAILED DESCRIPTION OF THE INVENTION

Figure 1:
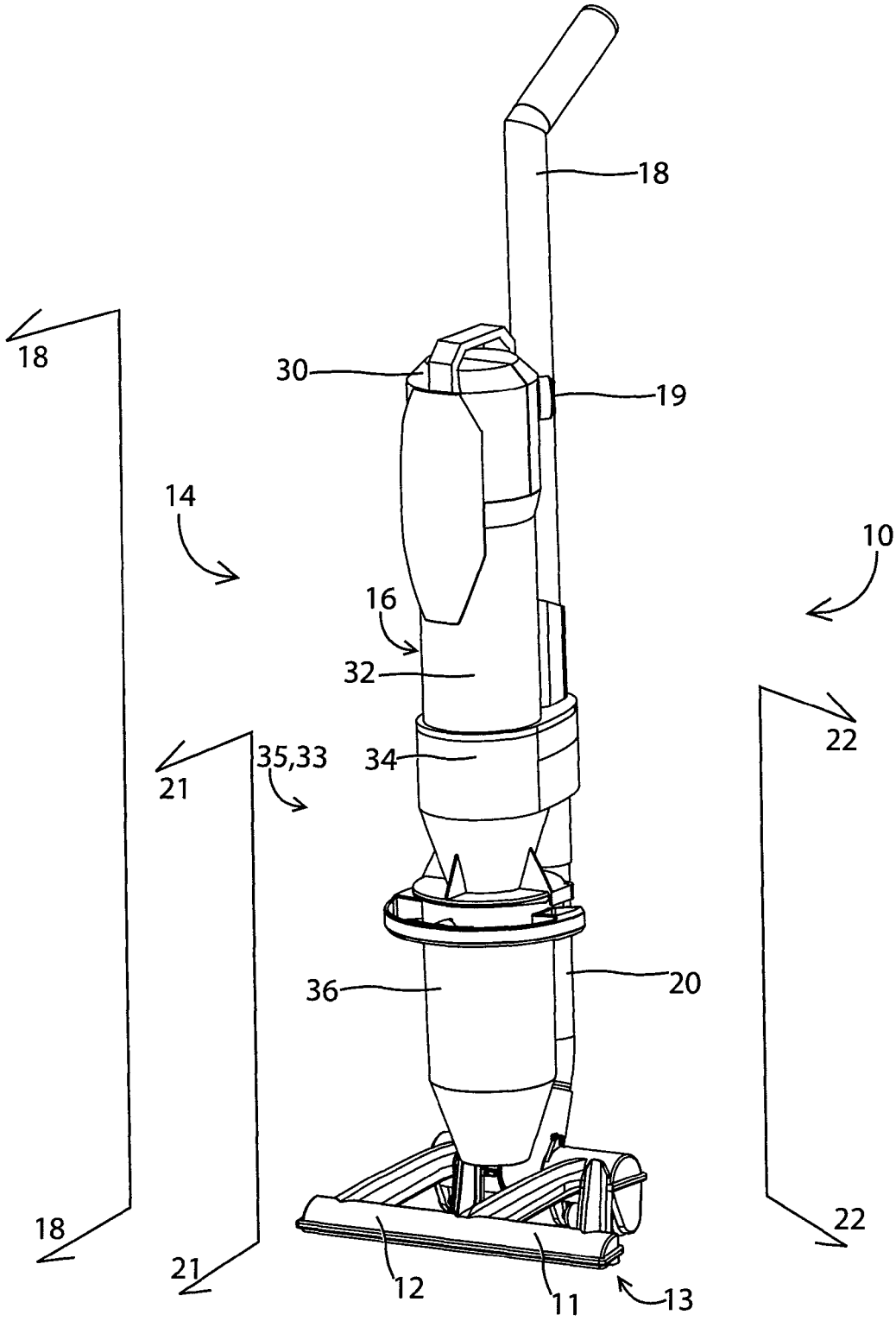
FIG. 1 is a perspective view of an upright vacuum cleaner according to a first embodiment of the instant invention.
Figure 2:
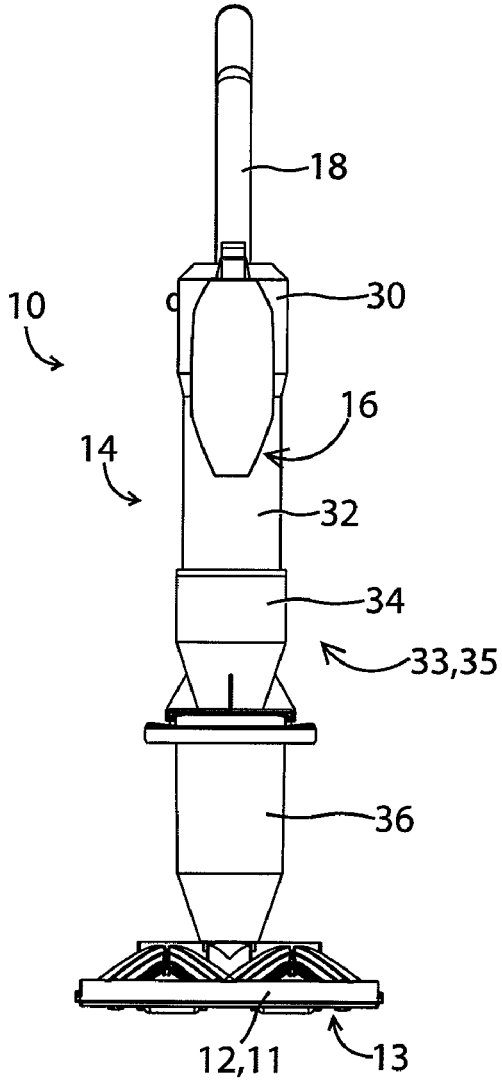
FIG. 2 is a front elevational view of the vacuum cleaner of FIG. 1.
Figure 3:
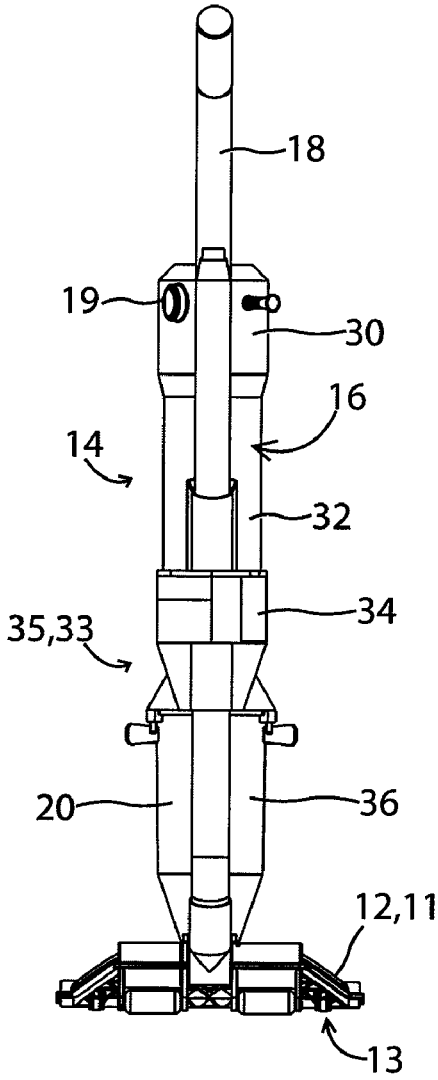
FIG. 3 is a rear elevational view of the upright vacuum cleaner of FIG. 1.
Figure 4:
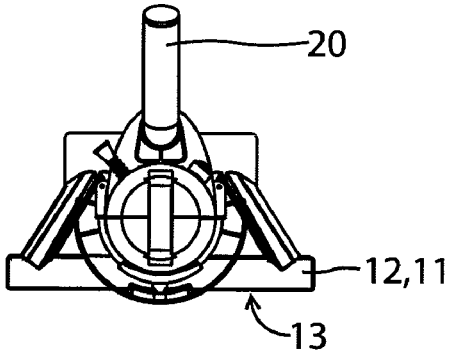
FIG. 4 is a top plan view of the upright vacuum cleaner of FIG. 1.
Figure 5:
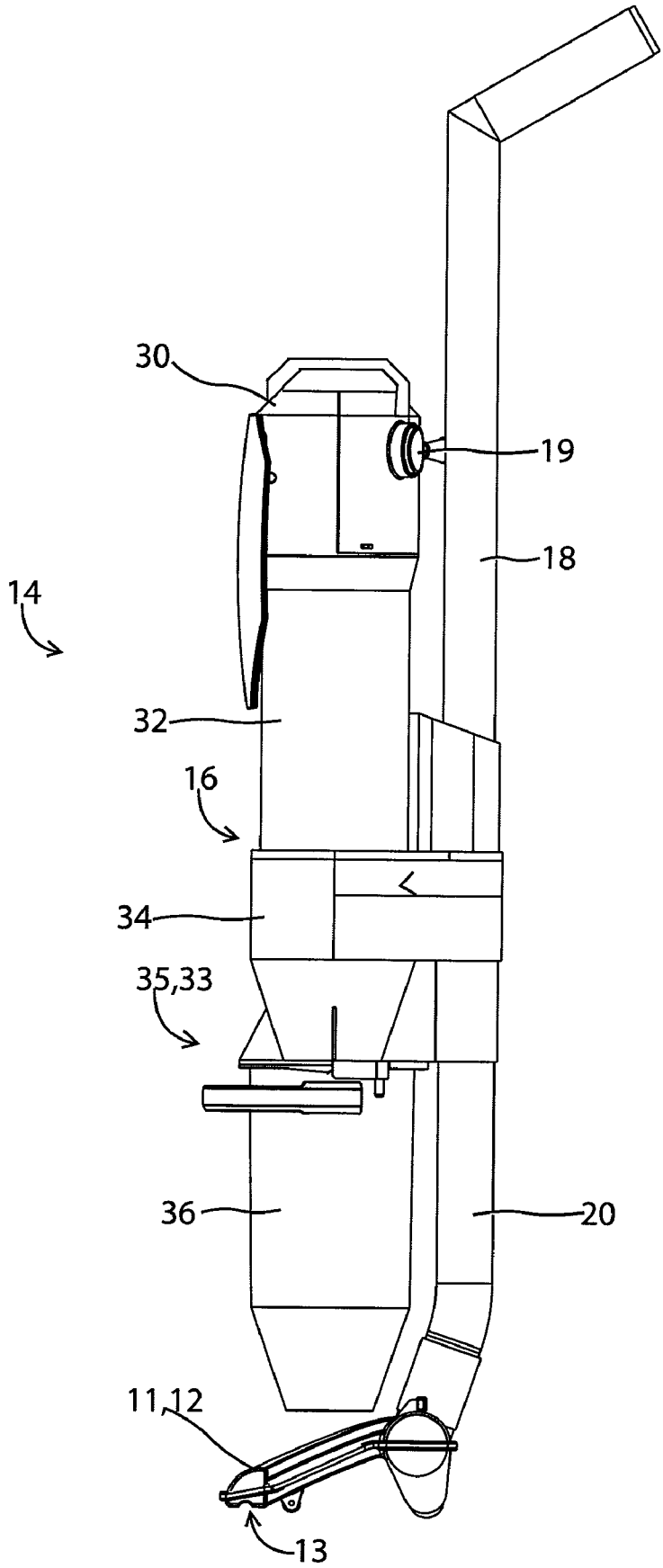
FIG. 5 is a side elevational view of the upright vacuum cleaner of FIG. 1.

Referring to FIG. 1, a first embodiment of a surface cleaning apparatus of the present invention is exemplified. Alternately, the surface cleaning apparatus may be a wheel-mounted vacuum cleaner, e.g. mounted on a wheeled platform. In other embodiments, the surface cleaning apparatus may be another type of surface cleaning apparatus for example a canister type vacuum cleaner, a stick vacuum cleaner, a back pack vacuum cleaner, a hand-carryable vacuum cleaner, a carpet extractor or the like.

In the embodiment of FIG. 1, the surface cleaning apparatus is an upright vacuum cleaner 10. Vacuum cleaner 10 comprises a member 11 having a dirty fluid inlet 13. In the embodiment shown, member 11 is a surface cleaning head 12. A fluid flow path extends from the dirty fluid inlet to a clean air outlet 19 of the vacuum cleaner 10. Vacuum cleaner 10 further comprises and an upright section 14. Upright section 14 comprises an upper casing 16, which may house a plurality of operating components, such as a cyclonic cleaning unit 33, and a suction motor 29. Upper casing 16 is secured to one or both of a handle 18 and a handle extension 20. Handle 18 and/or handle extension 20 may be made from plastic, metal (e.g. aluminum) fiberglass or a carbon fiber composite.

Figure 6:
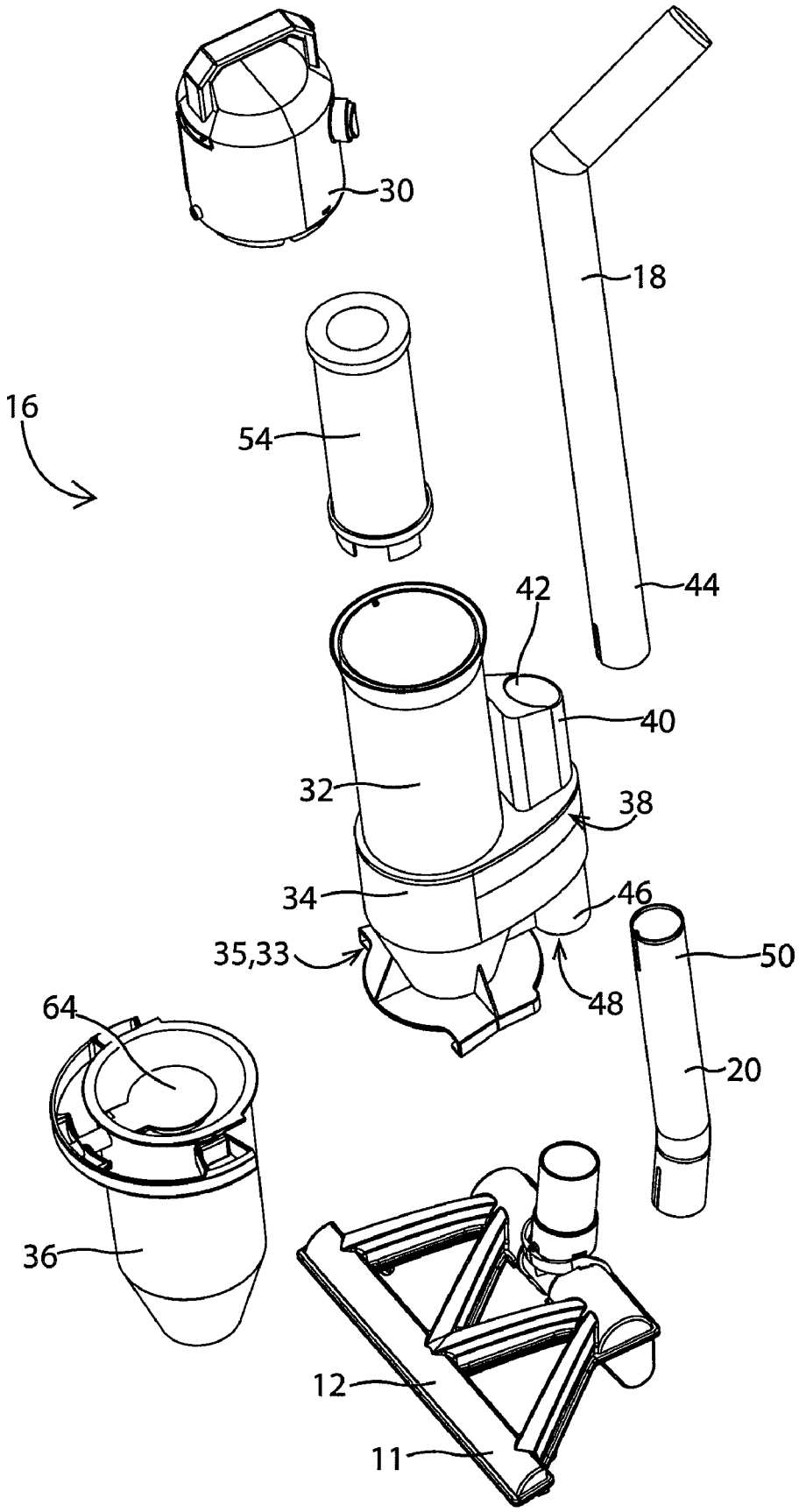
FIG. 6 is an exploded view of the upright vacuum cleaner of FIG. 1.
Figure 7:
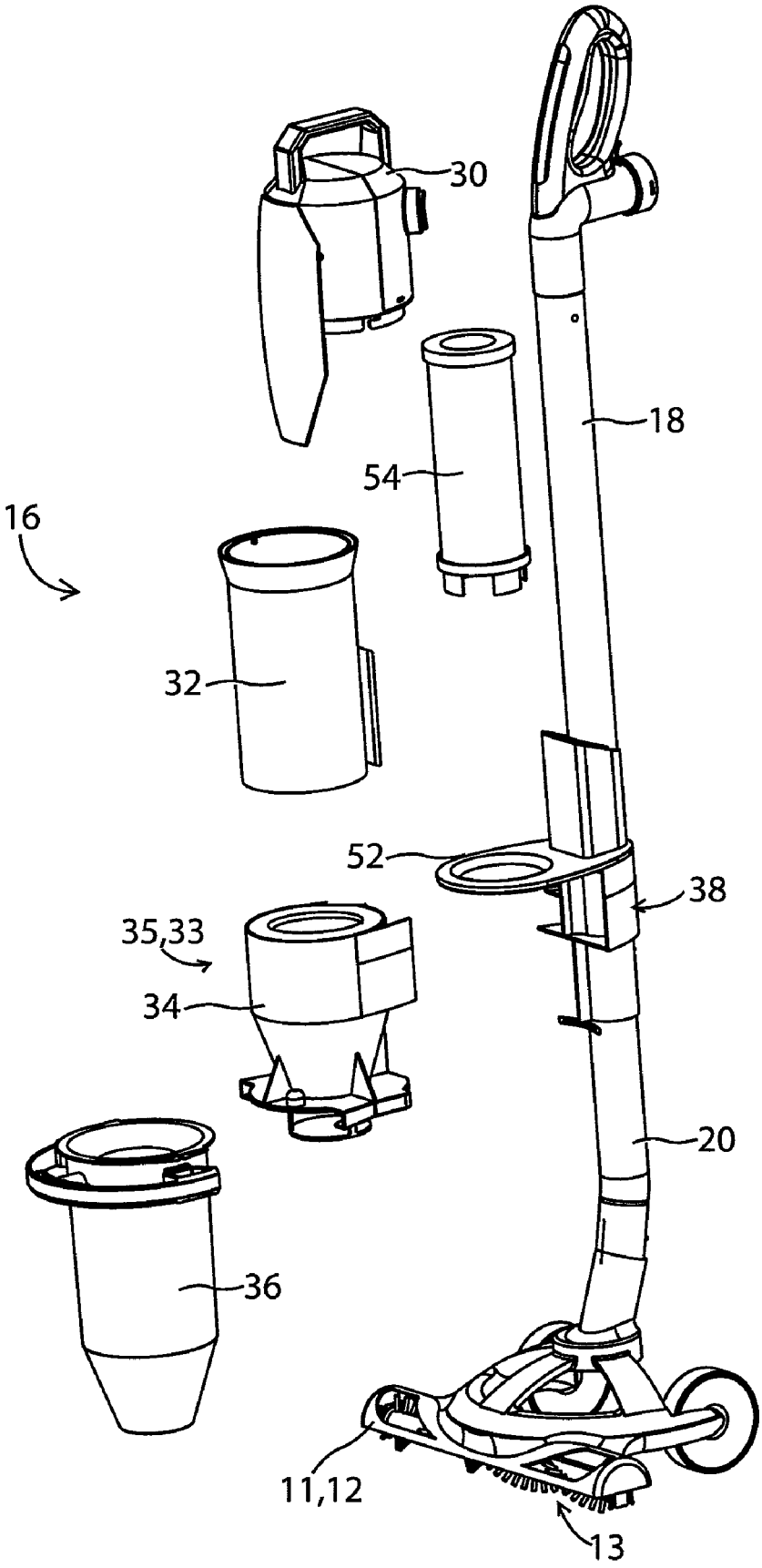
FIG. 7 is an exploded view of an alternate embodiment of the vacuum cleaner of FIG. 1.

Optional methods of securing upper casing 16 to handle 18 and/or handle extension 20 are shown in FIGS. 6 and 7. As shown in FIG. 6, the upper casing 16 comprises a plurality of operating components, such as a motor 29 housed in motor housing 30, a filter 54 housed in filtration housing 32, a cyclonic cleaning unit 33 comprising a first cyclonic cleaning stage 35 housed in a cyclone casing 34, and material collection chamber 36. In the embodiment of FIG. 6, filtration housing 32 and cyclone casing 34 are exemplified as a single structure. However, as shown in FIG. 7, they may be individual elements that may be secured together to define a portion of upper casing 16. In the embodiment of FIG. 6, one of the elements (e.g. filter housing 32) is provided with handle mount 38. Handle mount 38 has an upper portion 40 having an opening 42 for receiving lower end 44 of handle 18, and a lower portion 46 having an opening 48 for receiving upper end 50 of handle extension 20. Lower end 44 may be secured in opening 42 by any means known in the art, such as by an adhesive, a friction fit, a set screw or the like. Similarly, upper end 50 of handle extension 20 may be securely mounted in opening 48 by any such means.

It will be appreciated that handle mount 38 may be provided on only one of motor housing 30, filtration housing 32, cyclone casing 34, and chamber 36, or any combination thereof. For example, if handle mount is provided on filtration housing 32, then the remaining portions of upper casing 16 are preferably secured directly or indirectly to filtration housing 32. Accordingly, motor housing 30 may be secured to the upper portion of filtration housing 32, cyclone casing may be secured to the bottom portion of filtration housing 32 and chamber 36 is indirectly mounted to filtration housing 32 by being mounted to the lower portion of cyclone casing 34. Each of these members may be secured together by any means known in the art. For example, they may be mounted together by means of a bayonet mount, a screw thread, screws and optionally an adhesive or welding if the members need not be removed in use.

In the alternate embodiment shown in FIG. 7, handle mount 38 is a separate element that is shown mounted on handle 18 and handle extension 20. Handle mount 38 is provided with a securing ring 52. Accordingly, handle mount 38 is a component to which one or more of motor housing 30, filtration housing 32, cyclone casing 34 and chamber 36 may be mounted. Therefore, handle mount 38 is a separate element, which provides a member (e.g. securing ring 52) to which the remaining components are directly or indirectly attached. Securing ring 52 may be any member that provides a member to which one or more of the elements of the upper casing 16 may be secured and the remaining elements indirectly secured thereto, by being secured to other components of upper casing 16.

An advantage of such a design is that, if the operating components of the upper casing are removably attached to each other, the upper casing may be easily disassembled for cleaning. In addition, if a component needs to be replaced, the user may merely acquire the required component (e.g. by purchasing it at a store or on line) and replace the faulty component. For example, if motor 29 fails, pursuant to a warranty plan, the manufacturer may merely ship the required motor housing 29 to the customer who may remove (e.g., unscrew) the motor housing having the faulty suction motor and replace it with the new replacement part.

A further advantage of this design is that filter 54 may be accessed for removal (for cleaning or replacement) by disassembling a portion of upper casing 16. For example, in the embodiments of FIGS. 6 and 7, filter 54 may be accessed by removing motor housing 30. Accordingly, a door or the like is not required in filter housing 32, thereby simplifying the construction of filter housing 32.

Figure 8:
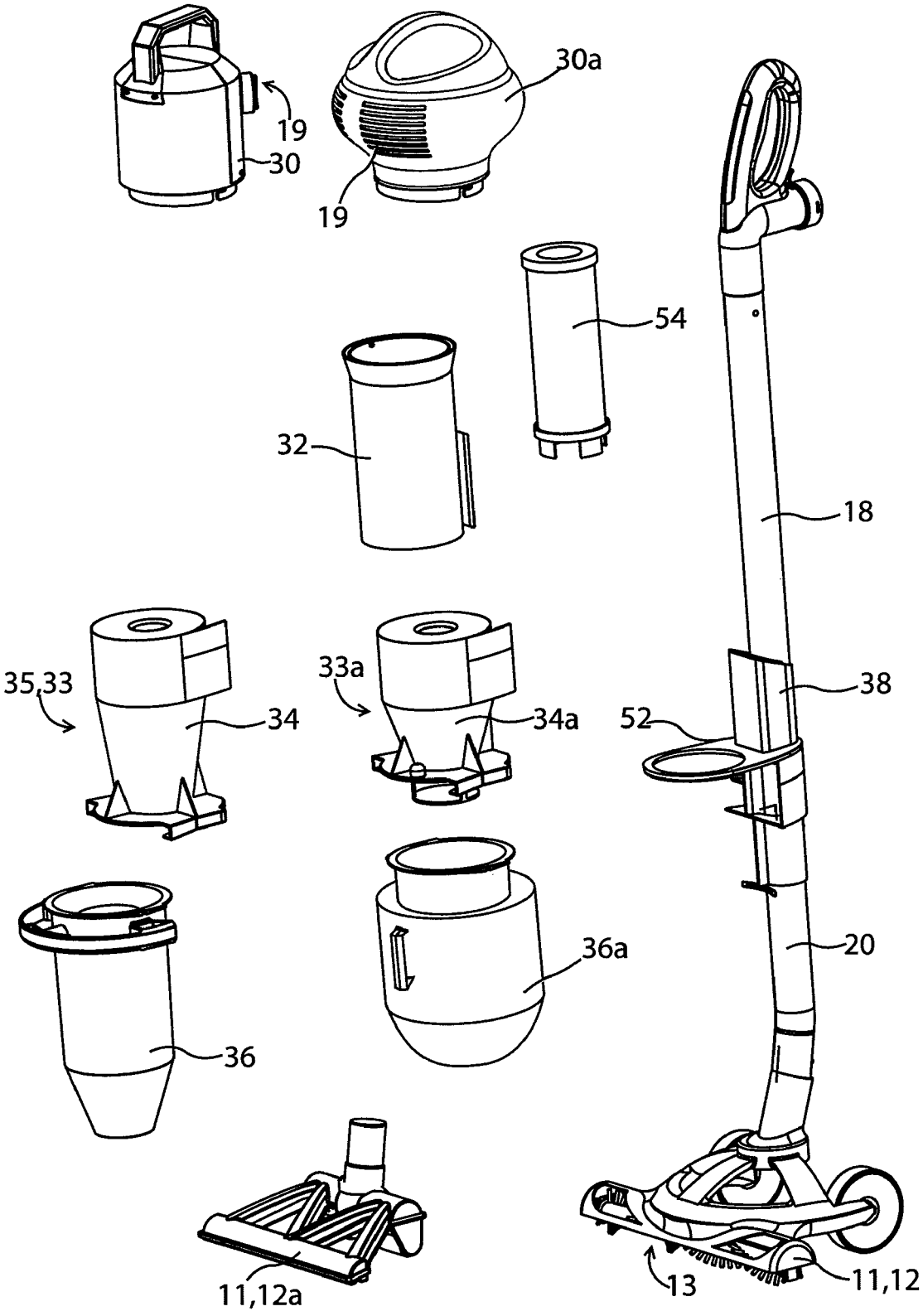
FIG. 8 is an exploded view showing a plurality of different components which are interchangeable and may be utilized to custom design different vacuum cleaners using common components.

A further advantage of this modular construction is that alternate vacuum cleaners may be created by providing interchangeable components for upper casing 16 and/or alternate surface cleaning heads 12. That is, vacuum cleaner 10 may be provided as a kit with interchangeable components. For example, referring to FIG. 8, a plurality of upright vacuum cleaners may be designed by utilizing alternate motor housings 30, 30*a*, housing alternate motors 29, alternate cyclonic cleaning units 33, 33*a* comprising alternate cyclone casings 34, 34*a*, alternate cyclone bins 36, 36*a* and/or alternate surface cleaning heads 12, 12*a*. In addition to being of a different shape, the motor housings 30, 30*a* may comprise motors 29 having a different amperage.

In some embodiments, the alternate cyclonic cleaning units 33, 33*a*, may be configured to separate material having different average particle sizes. In particular, it has been determined that avoiding abrupt changes in direction in the path of dirt which exits a cyclone chamber and enters a dirt collection chamber aids in the efficiency of a cyclone in removing dry wall dust. Accordingly, in some embodiments, a first cyclonic cleaning unit 33 may be provided which defines walls having abrupt changes, and a second cyclonic cleaning unit 33*a* interchangeable with cyclonic cleaning unit 33 may be provided which has a rounded inner lower wall portion (not shown). In an alternate embodiment, it will be appreciated that instead of changing cyclone casing 34, an insert may be provided in cyclone casing 34 to provide a rounded or radiused inner surface. Alternately, or in addition, the lower portion of cyclone casing 34 may be removable and replaceable with lower portions defining different inner wall profiles.

In other embodiments, the first cyclonic cleaning unit 33 may comprise a single cyclonic cleaning unit (as shown), and the second cyclonic cleaning unit 33*a* may comprise two cyclonic cleaning stages (not shown). Further, a cleaning unit having one cleaning stage may be interchangeable with a cleaning unit having two or more cleaning stages. Therefore, the number of cleaning stages may be varied, for example, depending on the type or variation of material to be collected.

Figure 9:
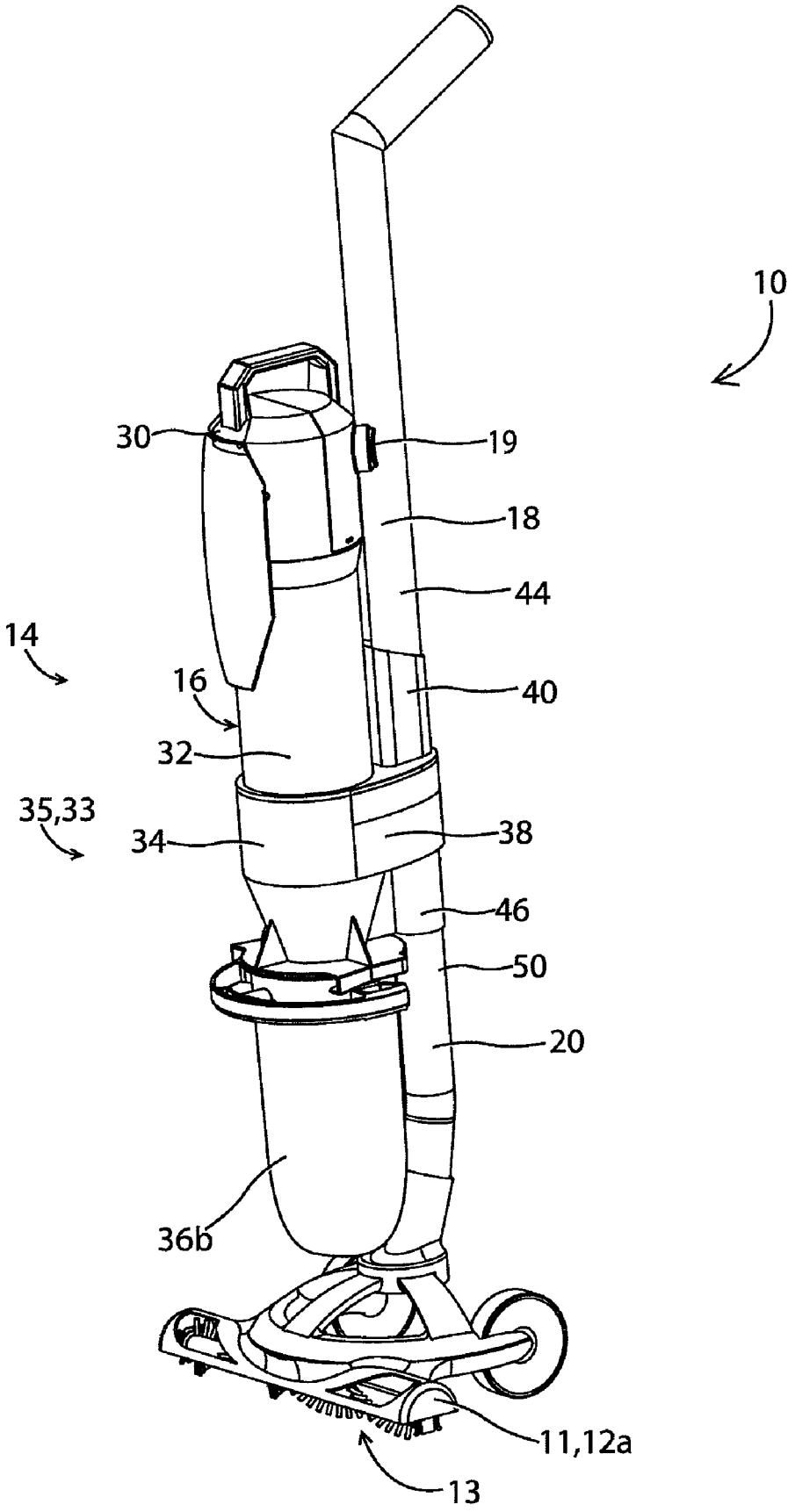
FIG. 9 is a perspective view of an alternate embodiment of a vacuum cleaner which may be constructed using the components of FIG. 8.
Figure 10:
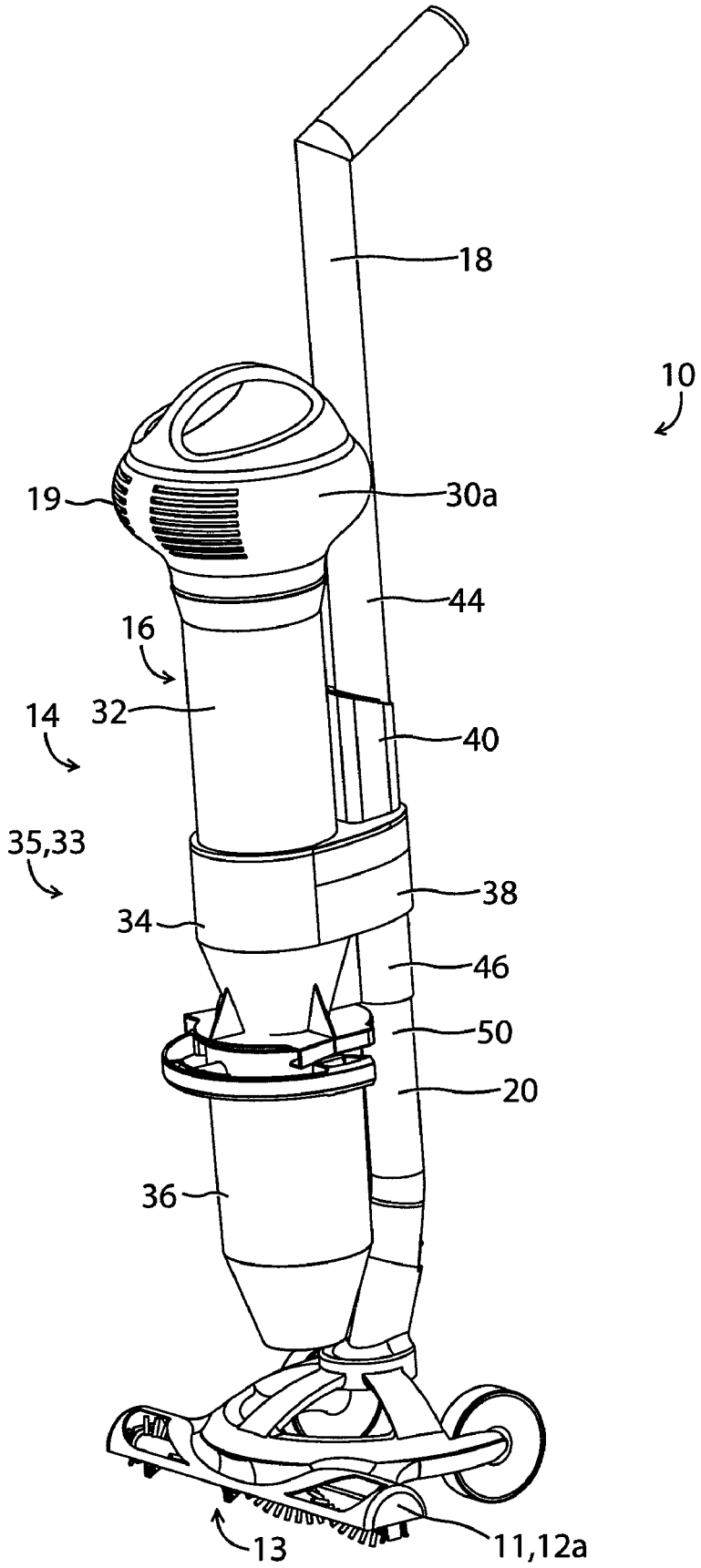
FIG. 10 is a further alternate embodiment of a vacuum cleaner which may be constructed using the components of FIG. 8.
Figure 11A:
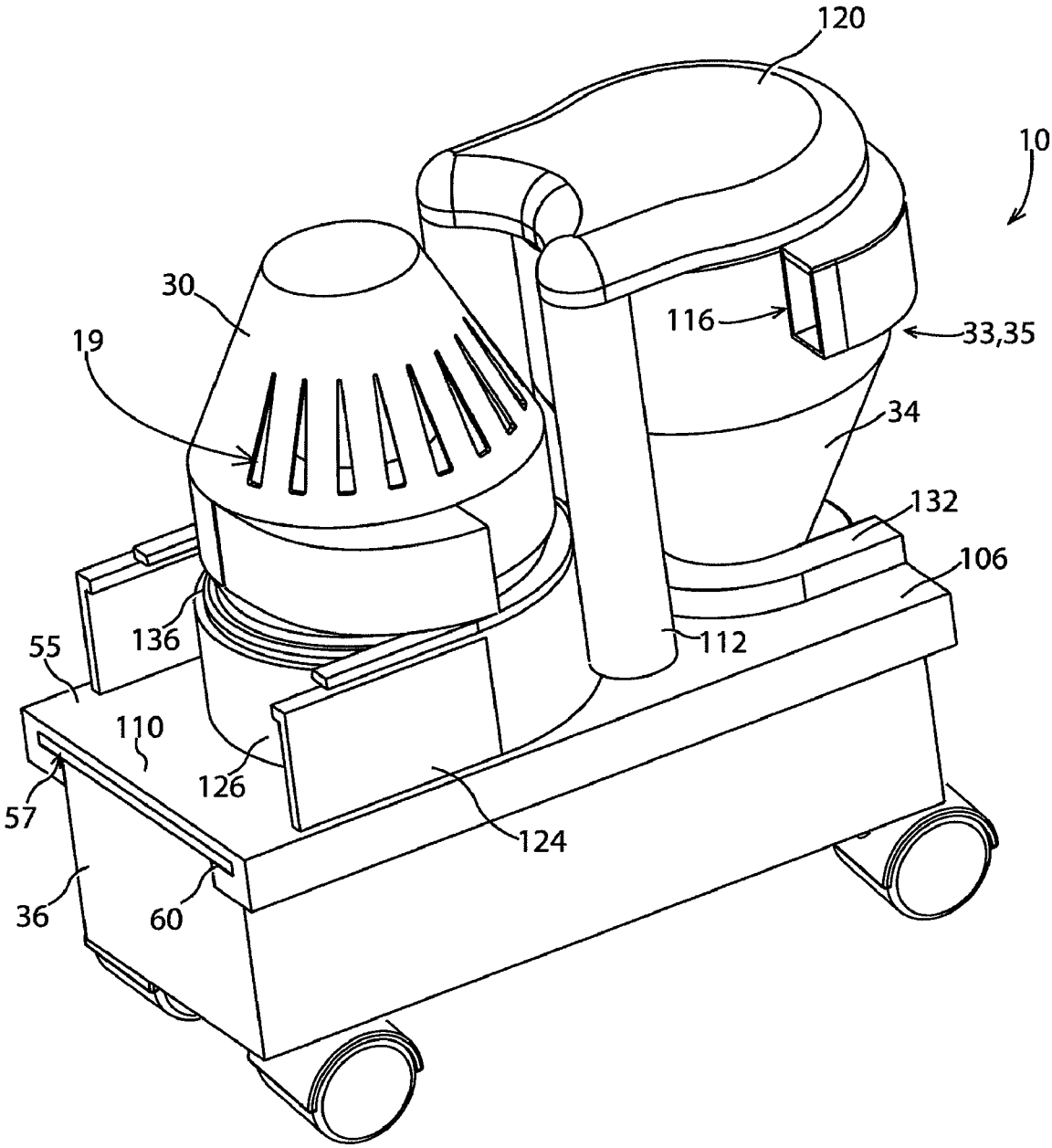
FIG. 11A is a perspective view of a canister or wet/dry vacuum cleaner according to another embodiment of the invention.
Figure 11B:
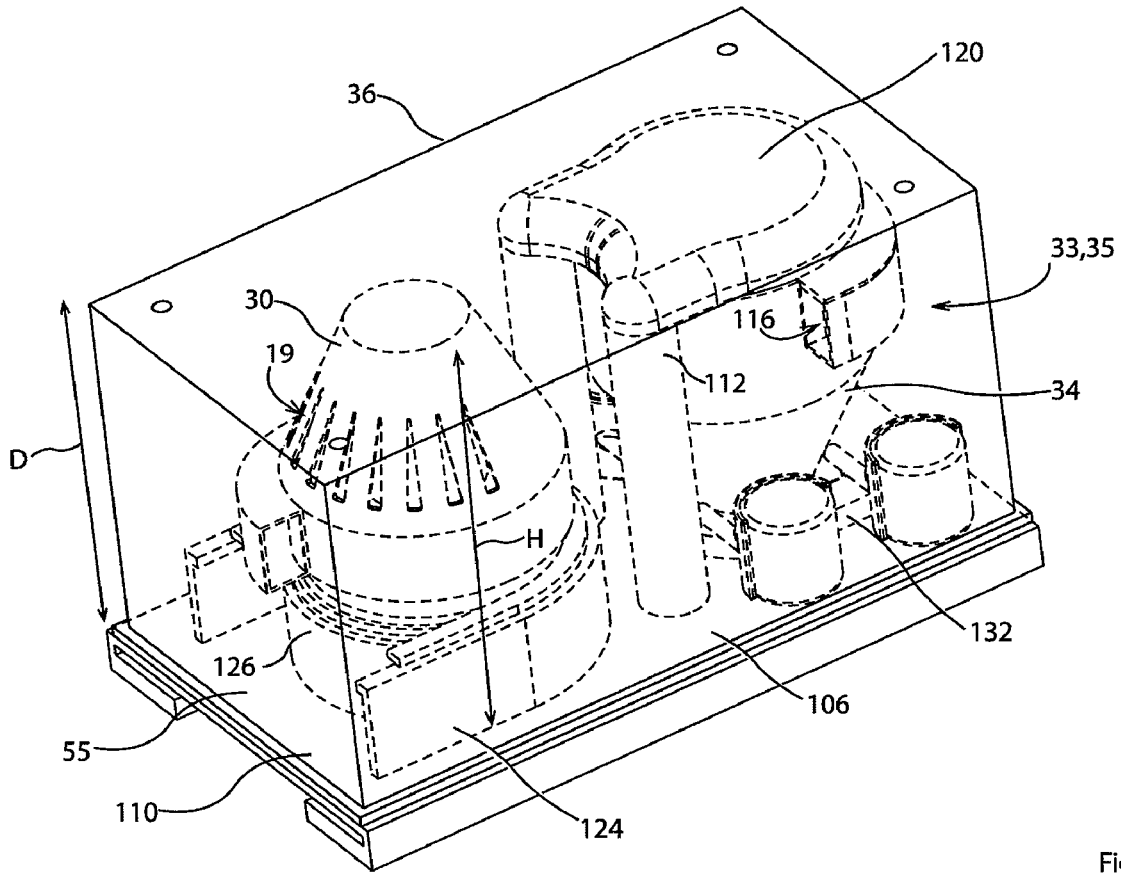
FIG. 11B is a perspective view of the vacuum cleaner of FIG. 11A wherein the components are nested for shipping.
Figure 12:
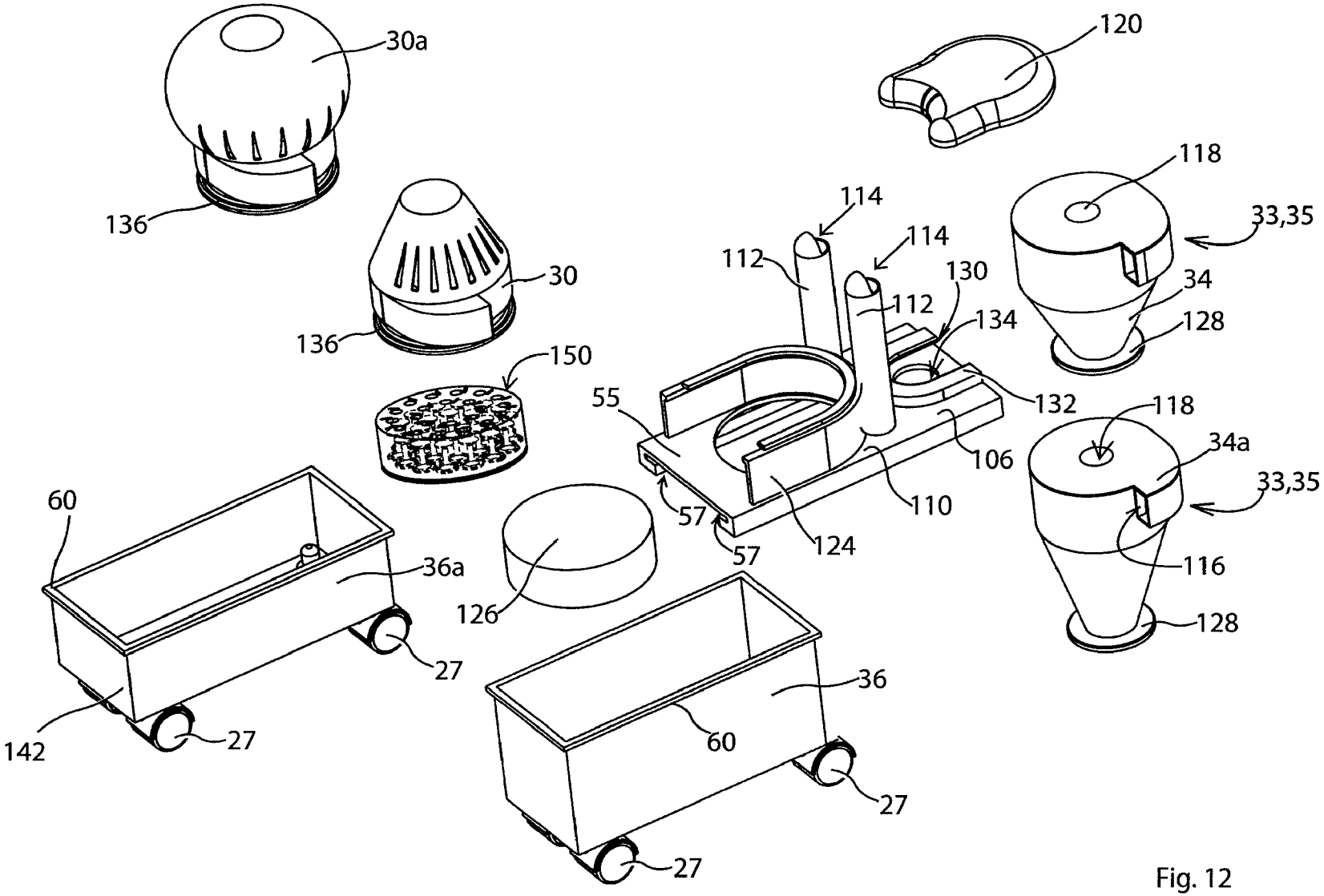
FIG. 12 is an exploded view showing a plurality of components which may be utilized to construct a canister or a wet/dry vacuum cleaner according to this alternate aspect of the invention.
Figure 13:
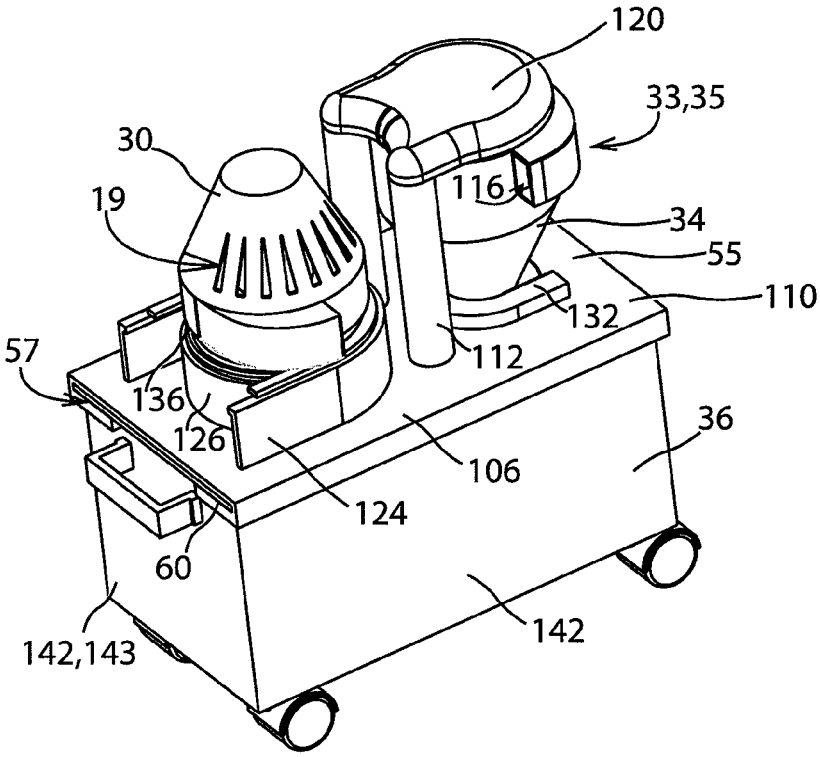
FIG. 13 is a perspective view of an alternate embodiment of the canister or wet/dry vacuum cleaner of FIG. 11A wherein a side door is provided on the chamber.
Figure 14:
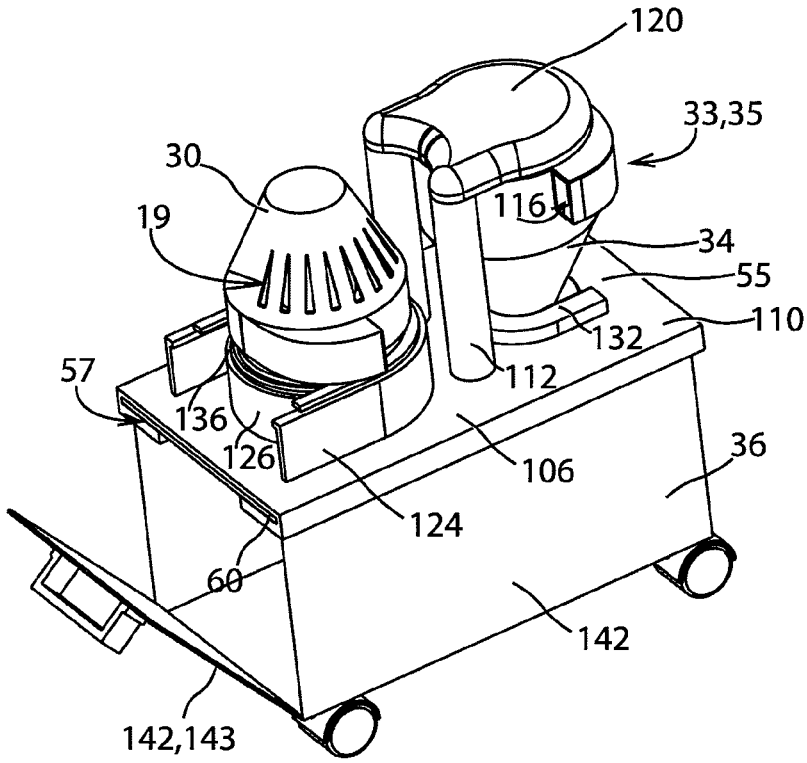
FIG. 14 is a perspective view of the vacuum cleaner of FIG. 11A wherein the door is open.

Preferably, a plurality of interchangeable motor casings, cyclone casings, chambers and cleaning heads 12 are provided. In addition, a plurality of handles 18, 18*a* may be provided. Accordingly, a plurality of vacuum cleaners having a different appearance may be prepared by selecting particular components. For example, as shown in FIG. 9, vacuum cleaner 10 utilizes the same components as the vacuum cleaner of FIG. 1 except that a different cyclone bin 36*b* and a different surface cleaning 12*a* are utilized. Accordingly, the vacuum cleaner has a different appearance. Similarly, with respect to FIG. 10, a different motor housing 30*a* and surface cleaning head 12*a* are utilized to create a vacuum cleaner of a different appearance to that of FIG. 1.

Accordingly, by utilizing a limited number of parts, a plurality of different vacuum cleaners may be created. This is possible as each motor housing 30, 30*a* is adapted to be mounted on any filtration casing 32. Similarly, any cyclone casing 34 is adapted to receive any bin 36 and to be mounted on any filtration housing 32. One particular advantage of this design is that unique products may be provided to different retailers without retooling an entire vacuum cleaner.

It will be appreciated that the interchangeable components may be used for several purposes. For example, one or more interchangeable components may be provided in a package of a surface cleaning apparatus that a consumer purchases in a store or on line, a surface cleaning apparatus may be sold with one or more removable components and one or more interchangeable components may be available for purchase separately, a company could produce a surface cleaning apparatus with interchangeable components so as to be able to provide products having different appearances and/or performance specifications to different customers and/or a purchaser (e.g., a retailer or an individual) may be able to select the desired components, such as on a web site maintained by the company, so as to have a surface cleaning apparatus custom made for them. It will be appreciated that in any of these modes, any one or more components may be available in different colors.

It will be appreciated that, in an alternate embodiment, upper casing 30 may have the units arranged in a different order. For example, motor housing 30 need not be provided on top of filtration housing 32. Instead, motor housing 30 could be provided in surface cleaning head 12 or beneath chamber 36. It will be appreciated that if the components are to be assembled in a different order (e.g., motor casing is to be provided at the lower portion of upper casing 16), then interchangeable components may be designed for such a configuration.

It will be appreciated that such an interchangeable construction may be used with any type of surface cleaning apparatus wherein at least one, and preferably more than one, operating component (e.g., a suction motor, a cleaning stage) are available. For example, an alternate embodiment of surface cleaning apparatus 10 is shown in FIGS. 11-17. In the embodiments shown, surface cleaning apparatus 10 is a canister or wet/dry vacuum cleaner 10, wherein operating components, such as a cleaning unit 33, defining a first cleaning stage 35 housed in cyclone casing 34, and a motor housing 30, are provided on the top 55 of material collection chamber 36.

In the embodiment of FIGS. 11-14, top 55 comprises a spine plate or top 106 having slots 57, in which material collection chamber 36 is slidably received. Accordingly, the top 55 is openable by sliding material collection chamber 36 away from top 55. A deformable seal or the like may be provided on a rim 60 to provide an air tight seal when vacuum cleaner 10 is in use. Cyclone casing 34 and a motor casing 30 are attached, and preferably separately attached, and, most preferably removably separately attached to top 55. In the embodiment shown, cyclone casing 34 and motor casing 30 are linearly arranged on top 55.

In the embodiment of FIGS. 11-14, spine plate 106 has a top surface 110 with down flow ducts 112. Cyclone casing 34 is provided with a cyclone outlet 118. Lid 120 is mounted on cyclone casing 34 and connects cyclone outlet 118 with the inlet 114 to down flow ducts 112. In operation, a member 11, such as a flexible hose may be secured to cyclone inlet 116. The air will travel through cyclone casing 34 and exit cyclone chamber 34 via outlet 118. Dirt removed from the air in cyclone casing 34 will enter material collection chamber 36 via inlet 134. The passage underneath lid 120 connects cyclone outlet 118 with inlets 114. The air will travel downwardly through down flow ducts 112 to a passage that connects with the inlet to motor housing 30. The air may travel through one or more filters in filter housing 126, prior to traveling to the suction motor and to outlet 122.

It will be appreciated that only one down flow duct 112 may be provided. In addition, a passage may be provided which extends inlet 116 to an alternate position on vacuum cleaner 10.

Cyclone casing 34 is preferably removably mountable on top surface 110 of top 55 by any means known in the art. For example, as exemplified in FIG. 12, top surface 110 is provided with a U shaped flange 132 so as to define a slot 130 that extends between U shaped flange 132 and top surface 110. Cyclone casing 34 is provided with a flange 128 at the bottom thereof. Accordingly, cyclone casing 34 may be mounted on top surface 110 by sliding flange 128 into slot 130. A deformable bead or the like may be positioned on the lower surface of flange 128 and/or top surface 110 around dirt inlet 134 so as to create an air tight seal.

Motor casing 30 may be secured to top surface 110 by any means known in the art. For example, a thread 136 may be provided at the lower portion of motor casing 30, which is matingly received in a thread provided in the top surface of filter housing 126 and/or material collection chamber 36 if filter housing 126 is not used. Filter housing 126 may be permanently mounted on top surface 110 or removably mounted thereon (such as by means of a screw thread, a slot and flange or the like). U shaped member 124 may be provided for assisting in seating filter housing 126 or motor housing 30 on spine plate 106.

Accordingly, in this embodiment, the cyclone casing and the motor casing are mounted and, preferably removably mounted to spine plate 106. Accordingly, referring to FIG. 12, one advantage of this aspect is that the design of the vacuum cleaner may be altered by providing interchangeable components. For example, motor casings 30 and 30*a* may be interchangeably usable on spine plate 106. Similarly, different cyclone casings 34 and 34*a* may be interchangeably usable on spine plate 106. In a particularly preferred embodiment, motor casings 30 and 30*a*, as well as cyclone casings 34 and 34*a*, may be used as alternate components for an upright vacuum cleaner (e.g., they may be interchangeable with the units shown, for example, in FIG. 8). Accordingly, a particular component may be used either in an upright vacuum cleaner or in a canister or wet/dry vacuum cleaner. In addition, different sized chambers 36, 36*a* may be utilized. Therefore, the vacuum cleaner 10 may use a smaller chamber 36*a* or a larger capacity chamber 36. Wheels 27 may be mounted directly on chamber 36 and/or spine plate 106.

A further advantage of the use of removable components is that, in some embodiments, the vacuum cleaner 10 may be manufactured and packaged for shipment wherein some of the components are nested in other components. That is the first cleaning stage 35 and the suction motor 29 may be insertable into the material collection chamber 36. In such embodiments, the chamber has a depth D, and the first cleaning stage 35 and the motor housing 30 and motor 29 have a maximum height H, which is less than the depth. As exemplified in FIG. 11B, the components are mounted to spine plate 106 and chamber 36 is inverted and placed over the top of spine plate 106. Wheels 27 are also placed within chamber 36. It will be appreciated that depending upon the size of the components, one or more motor housing 30 and/or one of more cyclone casing 34 may be mounted in dirt chamber 36, depending upon the size of the units. In addition, or alternately, dirt bin 36*a* may be nested in dirt bin 36 such that a vacuum cleaner may be sold with a plurality of dirt bins.

In an alternate embodiment, it will be appreciated that filter housing 126 may comprise one or more filters and, one or more cyclones and, preferably a plurality of cyclones in parallel, for example array 150 of cyclones in parallel.

In a further alternate embodiment, it will be appreciated that top 55 may be permanently mounted to material collection chamber 36. In such a case, as exemplified in FIGS. 13 and 14, one of sidewalls 142 may function as a door 143 for emptying material collection chamber 36 or may have a door formed therein. Door 143 preferably has a deformable seal (e.g. an member that is compressed when the door is locked into position to thereby provide an airtight and, preferably, water tight container).

Figure 15:
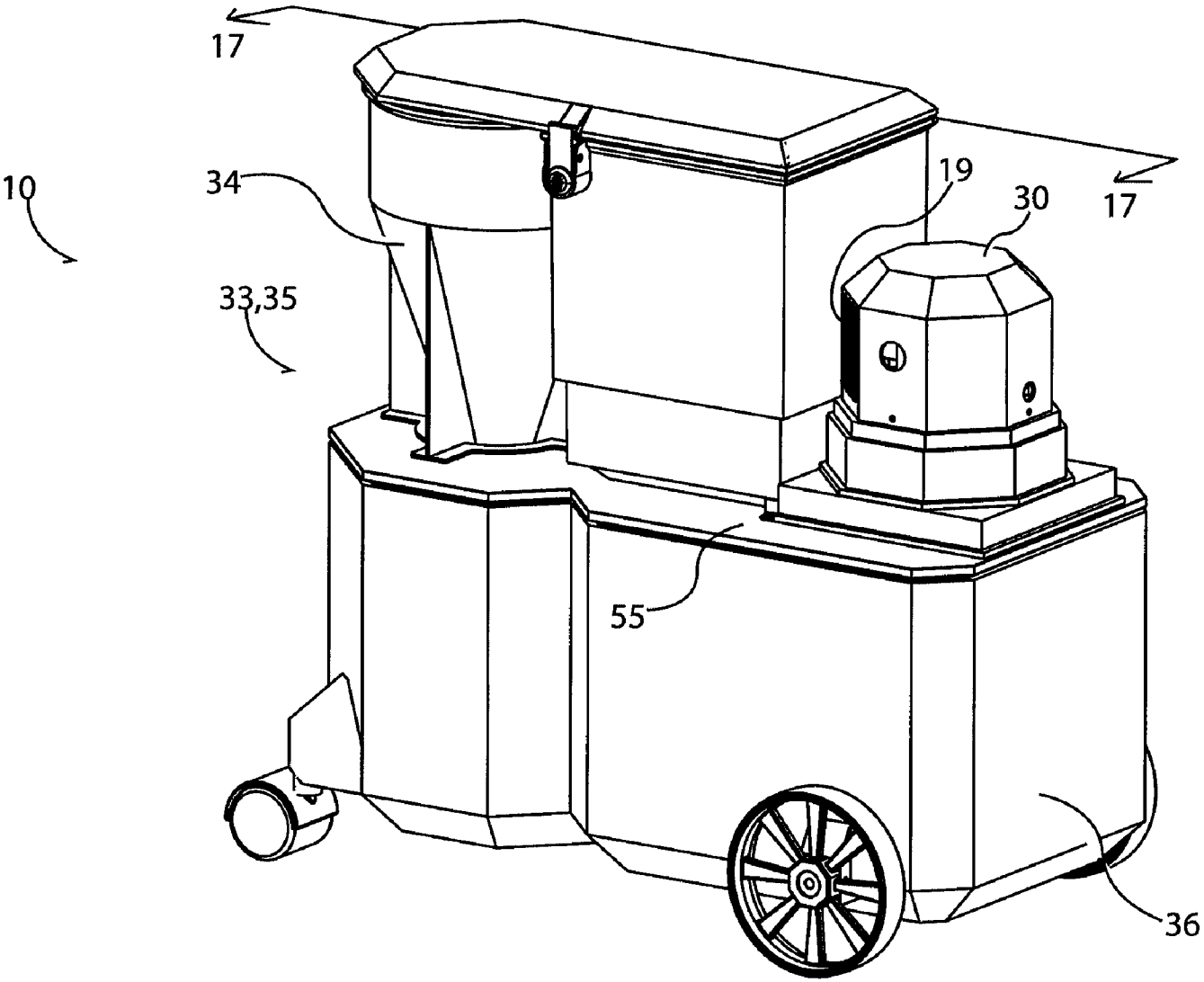
FIG. 15 is a perspective view of an alternate embodiment of a surface cleaning apparatus of the present invention.
Figure 16:
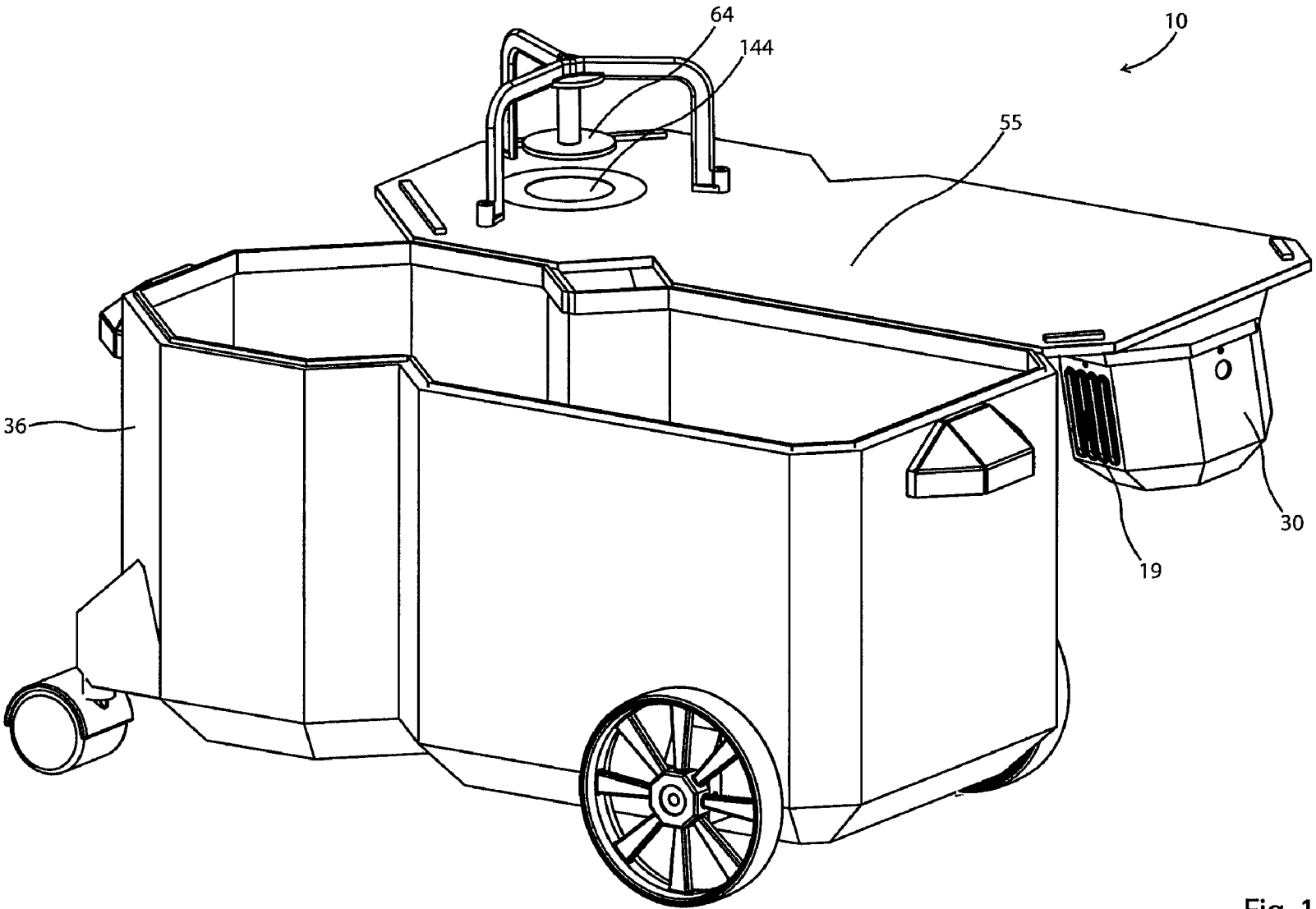
FIG. 16 is a perspective view of the embodiment of FIG. 15, showing a top in an open position.
Figure 17:
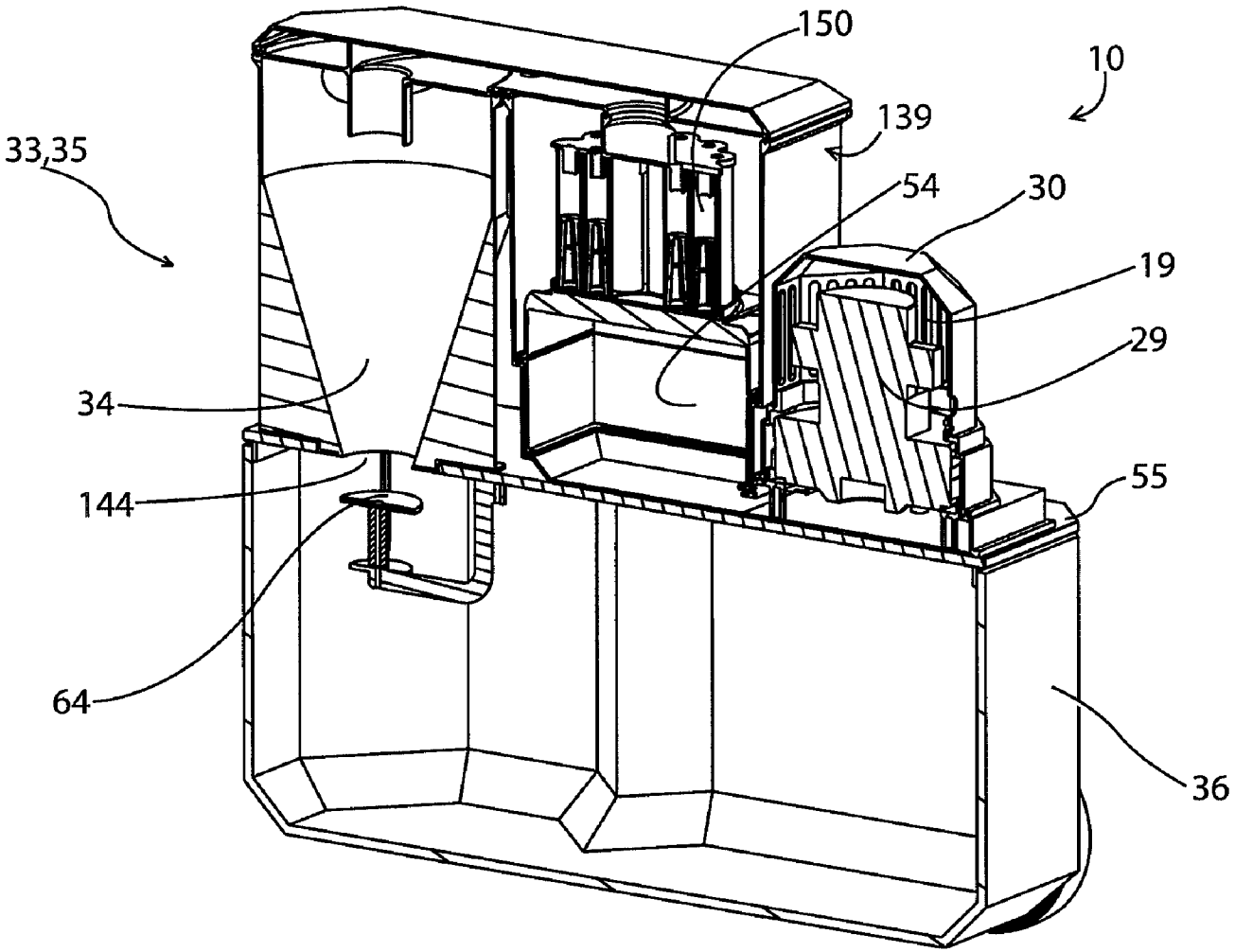
FIG. 17 is a cross section taken along line 17-17 in FIG. 15.

In the embodiment shown in FIGS. 15-17, top 55 is pivotally mounted to material collection chamber 36. Accordingly, the material collection chamber may be opened by pivoting top 55. In an alternate preferred embodiment, top 55 is removably mounted to collection chamber 36. Accordingly, top 55 may be inverted as shown in FIG. 16 and then placed on top of collection chamber 36. Thus, the volume occupied by the surface cleaning apparatus, e.g., during shipping or storage, may be reduced. Accordingly, the box for the surface cleaning apparatus may have a reduced height and more boxes may be placed in a shipping container. Accordingly, in accordance with one aspect of the present invention, one or more operating components are provided on top 55 and top 55 is placeble on the rim of collection chamber 36 in an inverted orientation. Preferably, the height of the components is less then the depth of collection chamber 36 so that the operating components are suspended above the bottom of collection chamber 36. It will be appreciated that the operating components (e.g., suction motor, cleaning units) may be permanently or removably mounted to top 55 in accordance with this aspect. Further, this aspect may be used with interchangeable components. In accordance with this aspect any cleaning stages or combination of cleaning stages may be used. Preferably, the cleaning stages comprise at least one cyclonic stage.

Similarly to the embodiments of FIGS. 11-16, operating components of the vacuum cleaner, such as cyclone casing 34 and motor housing 30 housing motor 29 are provided on top 55. In this embodiment, air is directed from a first cyclonic cleaning stage 35 to a second cyclonic cleaning stage 139, which is laterally spaced from the first cleaning stage. The second cleaning stage comprises an array of cyclones 150. From the second cleaning stage 139, air is directed through a filter 54, past motor 29, and out of the clean air outlet 19. In this embodiment, the first cleaning stage 35, second cleaning stage 139, and motor 29 are arranged linearly on top 55.

In any of the above embodiments, a divider plate 64 may be associated with a material outlet 144 of cyclone casing 34. Plate 64 may be any plate known in the art. The plate may be removable with chamber 36 from vacuum cleaner 10 (see for example the embodiment of FIG. 6). An advantage of this design is that plate 64 defines a partial cover for the chamber 36. Alternately, as shown in the embodiment of FIG. 7, plate 64 may remain in position when chamber 36 is removed. In such an embodiment, plate 64 is preferably attached to the bottom of cyclone casing 34.

If chamber 36 is separately removable from vacuum cleaner 10, then chamber 36 may be emptied by inverting it over a trash receptacle. In such a case, it will be appreciated that the bottom of chamber 36 need not be openable. Accordingly, the sides and bottom of chamber 36 may be integrally molded. In many vacuum cleaners that are currently on the market, the bottom of the chamber is pivotally mounted between a closed position and an open position. Accordingly, the chamber is emptied by pivoting the bottom to an open position. With such a design, air may leak into the chamber if the bottom is not properly sealed in place or if the seal is worn. During operation, a negative pressure is created in chamber 36. Accordingly, if air intrudes into chamber 36 via a leak, the dirt, which has collected in chamber 36, may be disturbed and re-entrained into cyclone casing 34. A further advantage of utilizing a chamber with a sealed bottom is that the vacuum cleaner may be used as a wet/dry vacuum cleaner. In particular, if the bottom is integrally formed or glued or welded to the sidewall of chamber 36, then there is no concern that water may leak out of a pivotally mounted bottom.

Figure 18:
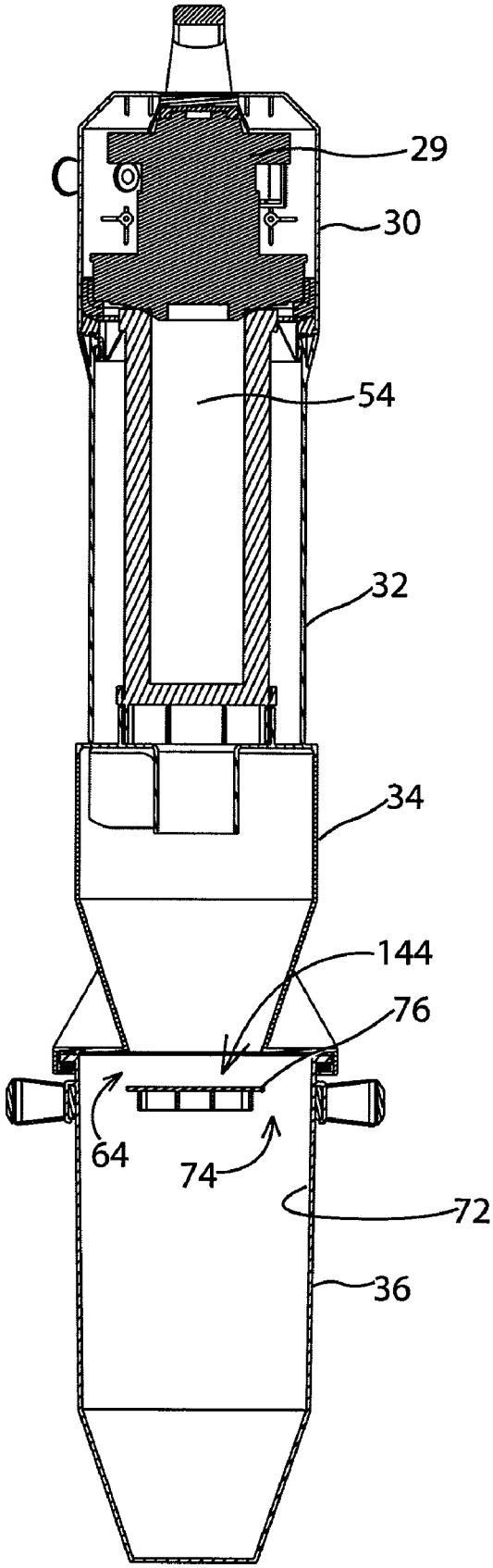
FIG. 18 is a cross section taken along line 18-18 in FIG. 1

It will be appreciated that plate 64 may be positioned at any height in chamber 36. Preferably, plate 64 is positioned proximate the top of chamber 36 and proximate material outlet 144 from cyclone chamber 34. Accordingly, as shown in FIG. 18, essentially the entire volume of chamber 36 is available to function as dirt collection chamber 66. Preferably, as shown in the cross section of FIG. 18, plate 64 is positioned inwards from inner wall 72, except for the portion of inner wall 72 to which plate 64 may be attached, so as to define an annular gap 74 between the outer wall 76 of plate 64 and inner wall 72 of chamber 36. Preferably, the minimum distance between plate 64 and cyclone casing 34 or chamber 36, e.g., annular gap 74, is at least as large as the largest dimension of the cyclone inlet. For example, if the cyclone inlet has a 1 inch diameter, then the minimum distance between plate 64 and cyclone casing 34 or chamber 36 is preferably is 1 inch or larger. An advantage of such a design is that any dirt particle that enters the cyclone chamber 34 will be able to pass through gap 74 into dirt collection chamber 36. The distance between the top of plate 64 and the bottom of the cyclone casing may be 0.01-2.5 inches and is preferably at least the largest diameter of the cyclone inlet.

Figure 20:
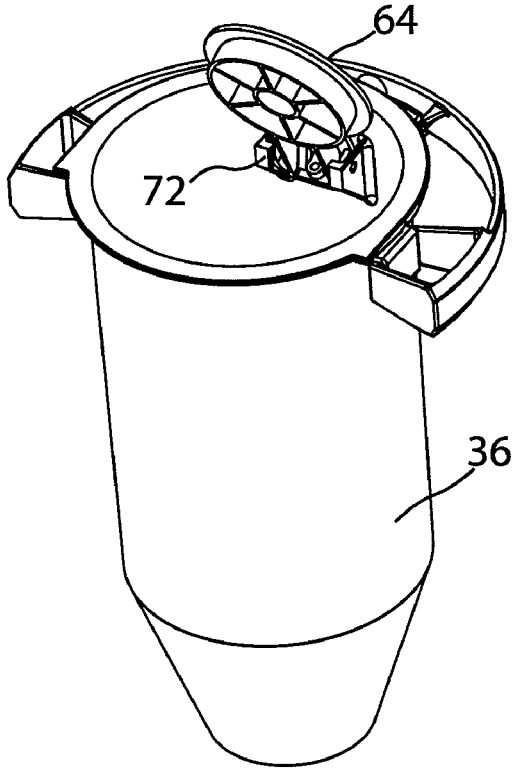
FIG. 20 is a perspective view of the embodiment of FIG. 19, showing a divider plate in a second position.
Figure 19:
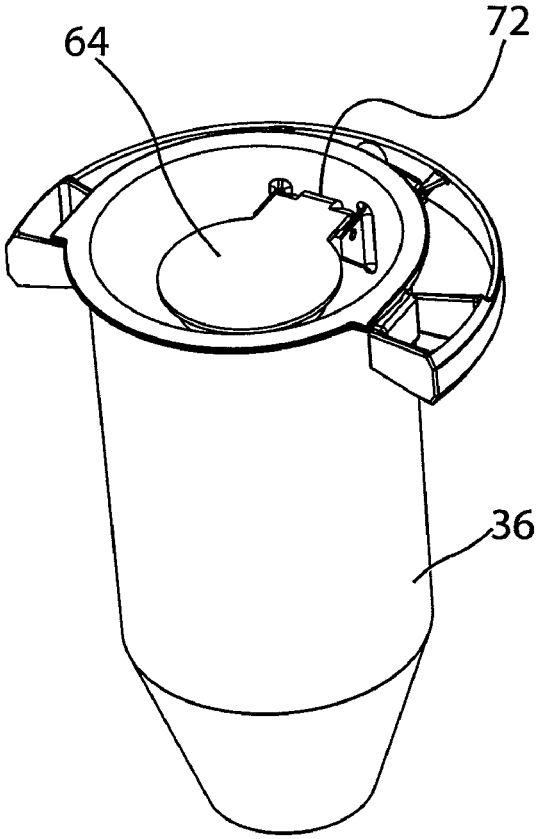
FIG. 19 is a perspective view of a material collection chamber of the present invention, showing a divider plate in a first position.
Figure 21:
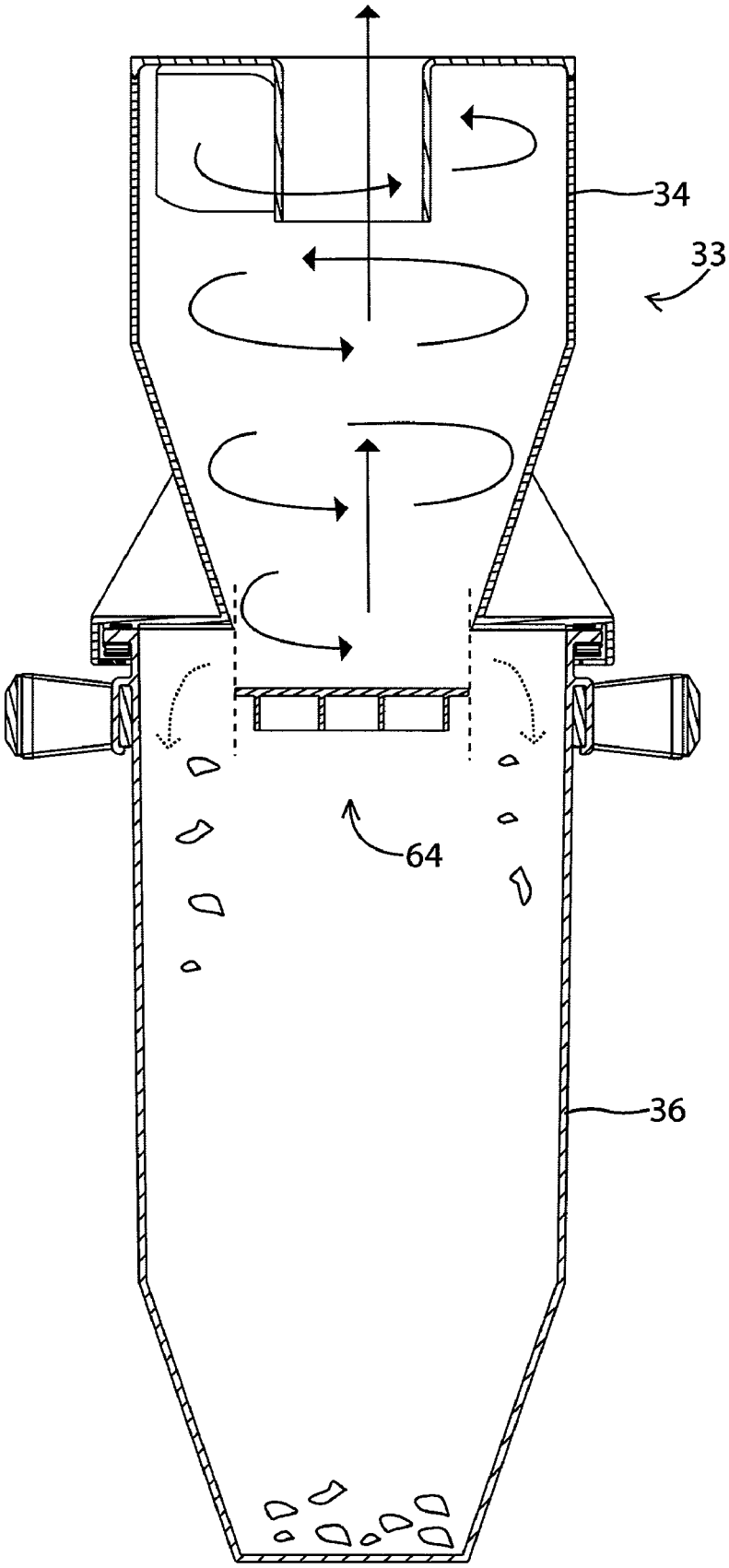
FIG. 21 is a cross section taken along line 21-21 in FIG. 1.
Figure 22B:
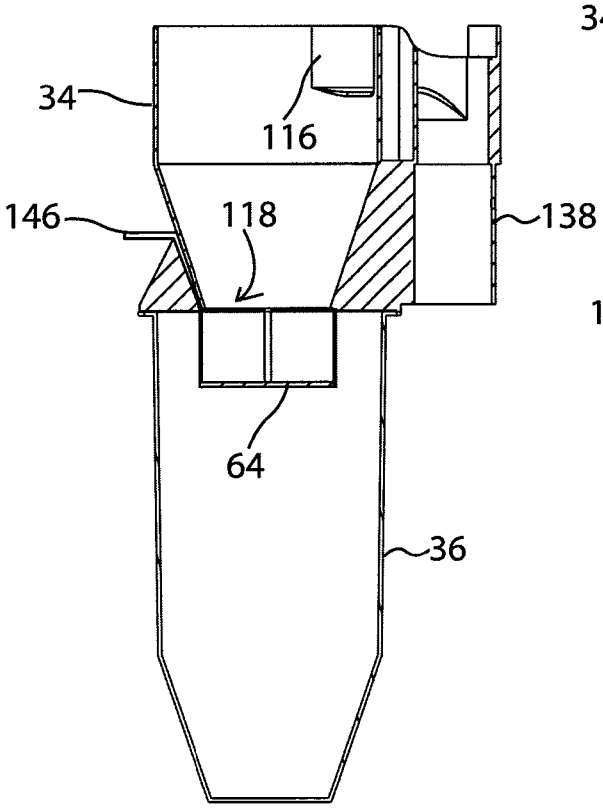
FIG. 22*b* is a cross section taken along line 22-22 in FIG. 1, showing the cyclone chamber and divider plate of FIG. 22*a;*
Figure 22C:
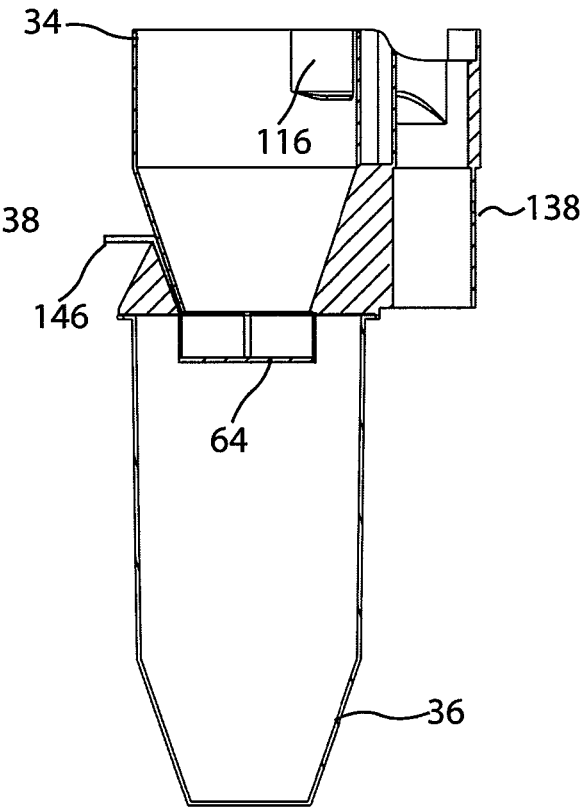
FIG. 22*c* is a perspective view of the cyclone chamber and divider plate of FIG. 22*a*, showing the divider plate in a second position.
Figure 22A:
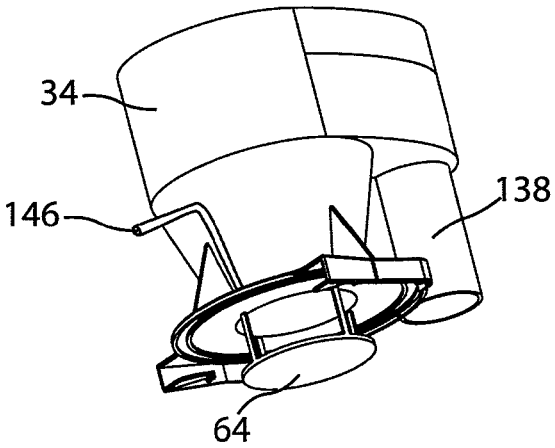
FIG. 22*a* is perspective view of a cyclone chamber and divider plate of the present invention, showing the divider plate in a first position.
Figure 22D:
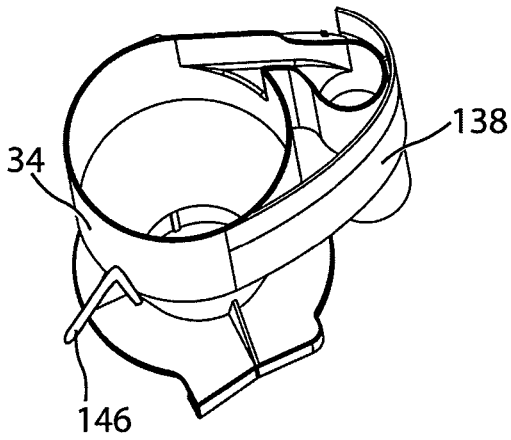
FIG. 22*d* is a cross section taken along line 22-22 in FIG. 1, showing the divider plate of FIG. 22*c;*
Figure 22E:
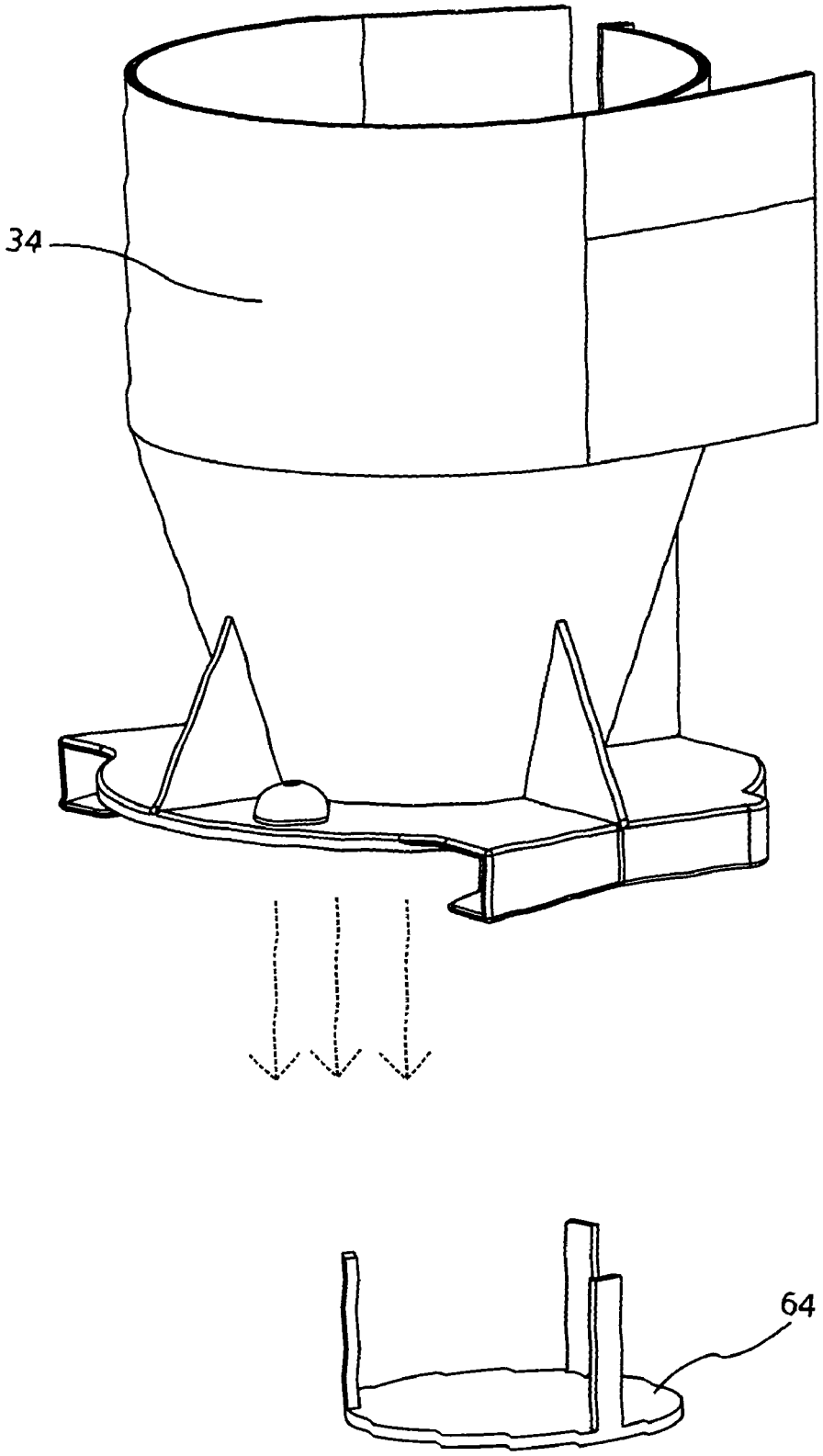
FIG. 22*e* is a perspective view of a cyclone chamber and divider plate of the present invention, wherein the divider plate is removable.
Figure 23:
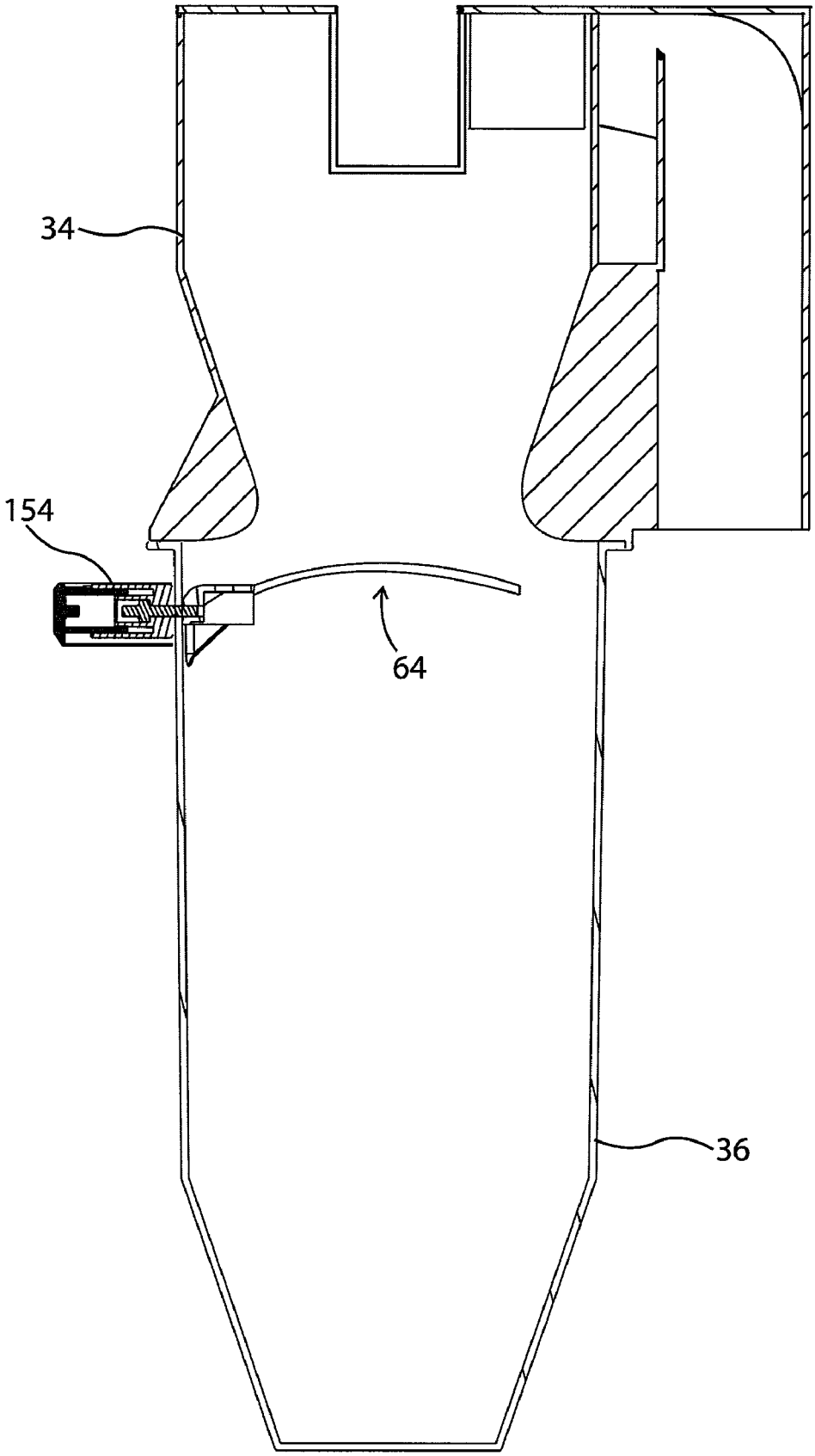
FIG. 23 is a cross-section taken along line 22-22 in FIG. 1, wherein a mount is not shown.
Figure 24B:
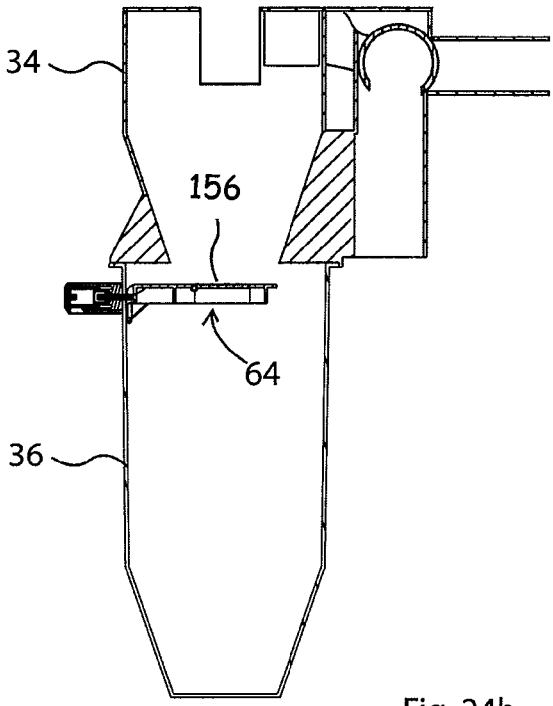
FIG. 24*b* is a cross section taken along line 22-22 in FIG. 1, showing the cyclone chamber and divider plate of FIG. 24*a;*
Figure 24D:
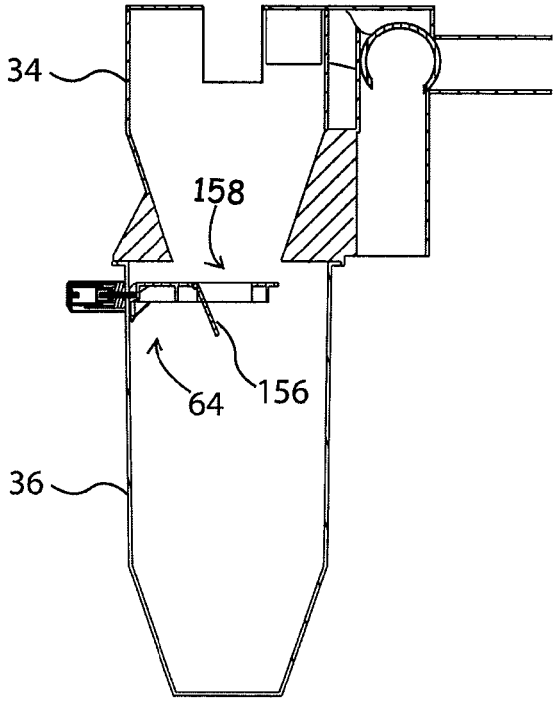
FIG. 24*d* is a cross section taken along line 22-22 in FIG. 1, showing the divider plate of FIG. 24*c;*
Figure 24A:
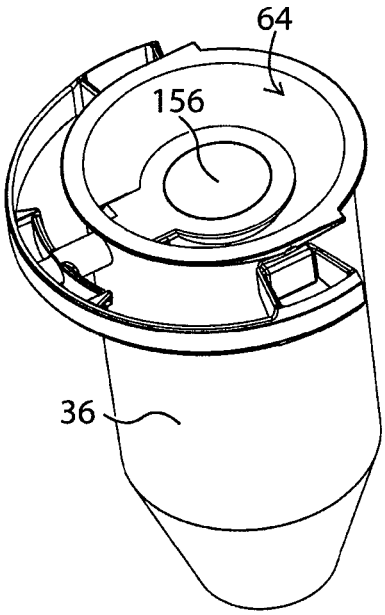
FIG. 24*a* is perspective view of a cyclone chamber and alternate divider plate of the present invention, showing the divider plate in a closed configuration.
Figure 24C:
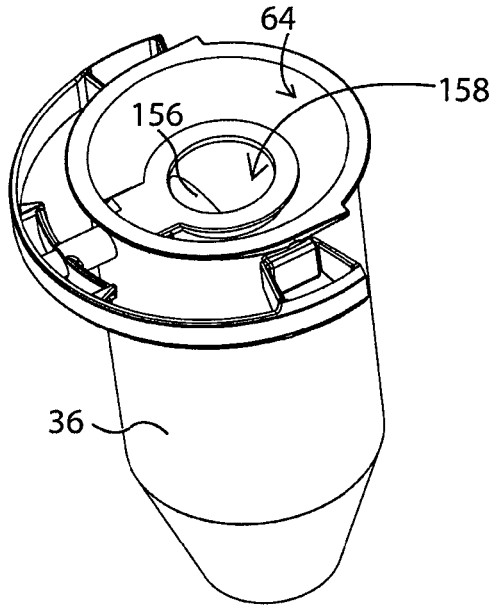
FIG. 24*c* is a perspective view of the cyclone chamber and divider plate of FIG. 24*a*, showing the divider plate in an open position.
Figure 25B:
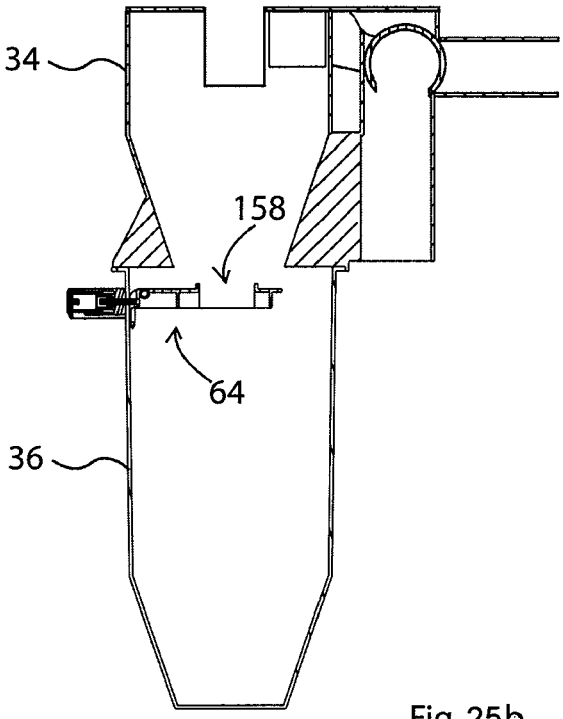
FIG. 25*b* is a cross section taken along line 22-22 in FIG. 1, showing the cyclone chamber and divider plate of FIG. 25*a;*
Figure 25D:
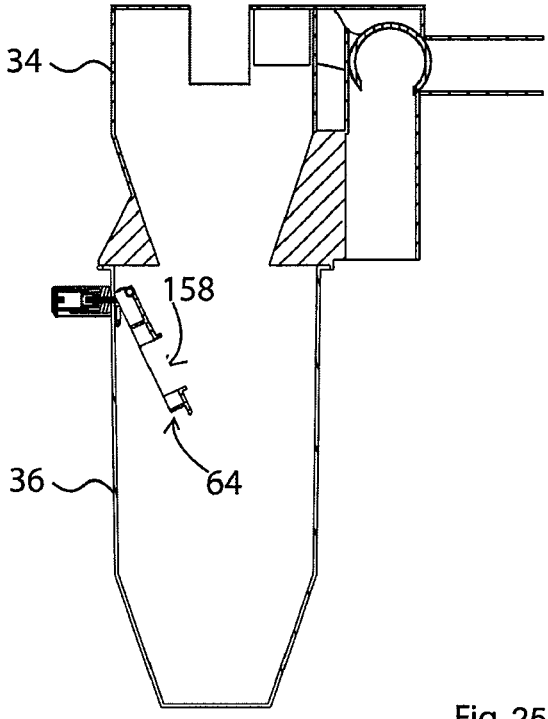
FIG. 25*a* is perspective view of a cyclone chamber and alternate divider plate of the present invention, showing the divider plate in a first position.
FIG. 25*c* is a perspective view of the cyclone chamber and divider plate of FIG. 25*a*, showing the divider plate in a second position; and, FIG. 25*d* is a cross section taken along line 22-22 in FIG. 1, showing the divider plate of FIG. 25*c;*
Figure 25A:
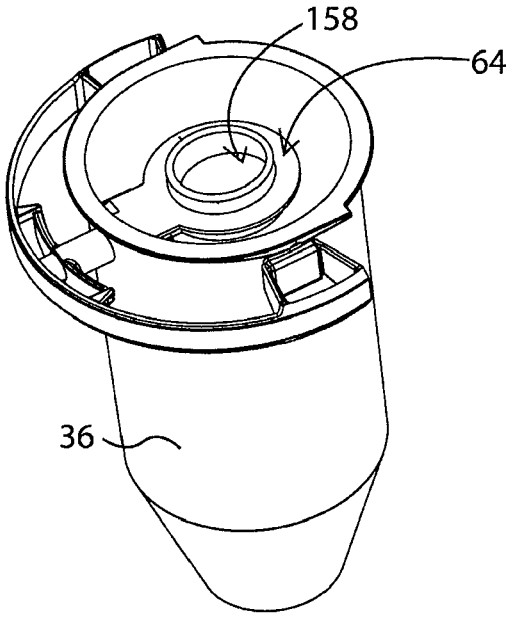
Figure 25C:
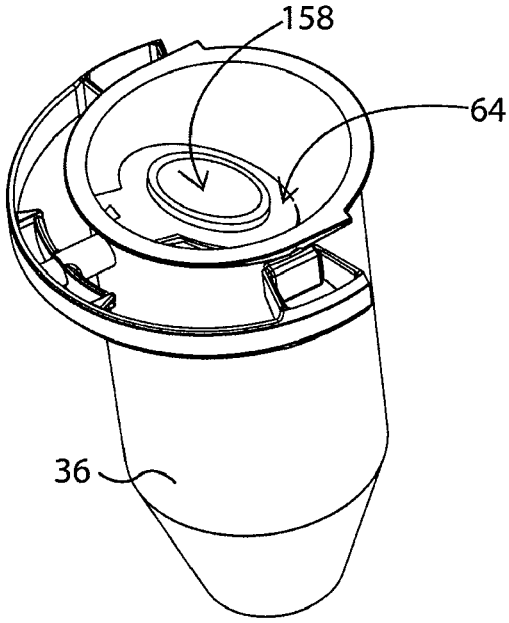

In some embodiments, as exemplified in FIGS. 19 and 20, plate is pivotally mounted to the surface cleaning apparatus, e.g., the collection chamber. That is, plate 64 is pivotally mounted to inner wall 72. Accordingly, plate 64 may be in the horizontal or closed position shown in FIG. 19 when vacuum cleaner 10 is in use and when chamber is removed from the vacuum cleaner. When chamber 36 is inverted for emptying, plate 64 may pivot to an open position (as exemplified in FIG. 20) due to gravity. If plate 64 is pivotally mounted to the inner wall 72 of chamber 36, then annular gap 74 is preferably at least one inch. Such a configuration permits plate 64 to pivot open to permit dirt to be emptied out of chamber 36 when chamber 36 is inverted.

Plate 64 may have the same diameter as the cyclone outlet 118. Accordingly, if the cyclone is cylindrical, then the diameter of plate 64 may be the same as the diameter of the cyclone. Alternately, as shown in FIG. 22, if the cyclone is tapered, plate 64 may have the same diameter as the material outlet 144 of cyclone casing 34. Alternately, plate 64 may have a larger diameter. It will be appreciated that if the cyclone is conical, then plate 64 may have a diameter that is equal to the projected diameter of an end of the cone that is projected to the top of plate 64.

In accordance with another aspect of this invention, plate 64 may be reconfigurable to adapt the vacuum cleaner to collect different types of particulate matter. For example, it may be desirable to utilize the vacuum cleaner to collect dry wall dust. Accordingly, the vacuum cleaner may be reconfigurable in one of several ways. Referring to FIGS. 22*a*-22*d*, according to one option, lever 146 is drivingly connected to plate 64 so as to adjust the position of plate 64 with respect to outlet 144. Accordingly, if the vacuum cleaner is to be utilized to collect standard household dust including dog hair, then the lever 146 may be moved to a first position, shown in FIGS. 22*a* and 22*b*, which is better suited for collecting such material. However, if the vacuum cleaner is then going to be used to collect, for example, dry wall dust, the lever 146 may be used to a second position, shown in FIGS. 22*c* and 22*d*, wherein plate 64 is at a distance from outlet 144 that is more suited for the collection of dry wall dust. In a particularly preferred embodiment, a scale or labeled positions may be provided on the outer surface of chamber 36 to indicate the preferred position of lever 146 for different types of dust. Accordingly, in order to reconfigure vacuum cleaner 10 for a particular type of dirt, a user may merely move lever 146 to a pre-marked position. It will be appreciated that lever 146 may operate in a variety of ways, each of which is within the scope of this description. For example, lever 146 may be slidably mounted in a vertical direction so that as lever 146 is moved upwardly or downwardly, plate 64 is also moved upwardly or downwardly. Alternately, a gear or crank mechanism may be utilized such that as lever 146 is moved sideways or rotated, the height of plate 64 is adjusted.

An alternate way to reconfigure plate 64 is to use an alternate plate. For example, it will be appreciated that plate 64 may be removably mounted, either to chamber 36 or cyclone housing 34 (as exemplified in FIG. 22*e*). Accordingly, a plate having a different configuration, e.g., convex, may be selectively inserted.

Alternately, as exemplified in FIG. 24, a control 154 may be provided which, when actuated, will cause plate 64 to change its configuration. For example, a plurality of cables may extend underneath plate 64 and be connected to a take up reel, which is driven by rotation of control 154. Accordingly, when control 154 is turned and draws the cable onto the reel, plate 64 will deform to a position shown in FIG. 24. When control 154 is rotated in the opposite direction, the elasticity of plate 64 will cause it to revert to its original shape (e.g. flat).

Figure 26:
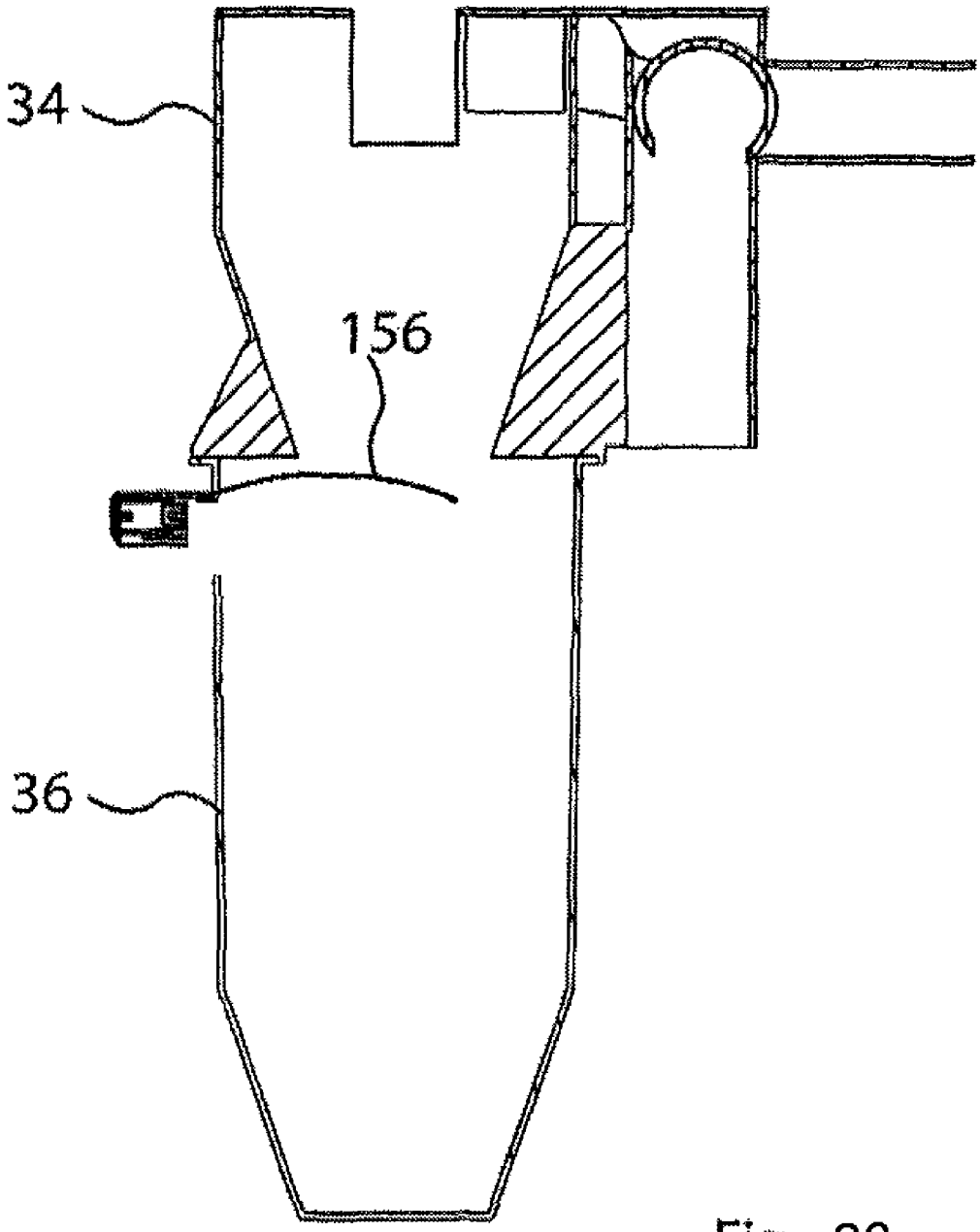
FIG. 26 is a cross-section taken along the line 22-22 in FIG. 1 showing the cyclone chamber and divider plate of FIG. 24*a* wherein the divider plate is in a bow-shaped configuration.

In an alternate embodiment, as shown in FIGS. 24*a*-24*d*, divider plate 64 may comprise a portion that is movable. For example, a central section 156 of plate 64 may be pivotally mounted, such that when central section 156 is pivoted away from plate 64, an opening 158 is defined in plate 64. Such an opening may be useful in allowing heavier material to pass into material collection chamber 36. Alternately, as shown in FIGS. 25*a*-25*d*, opening 158 may be permanently defined in divider plate 64. Alternately, a cop to cover opening 158 may be provided. In the embodiments of FIGS. 25-26, the divider plate 64 may be pivotally mounted, as described with reference to FIGS. 19 and 20, and/or movable, as described with reference to FIGS. 22*a*-22*d*.

It will be appreciated that a reconfigurable plate may be used with any cyclonic cleaning stage and any collection chamber construction. A reconfigurable plate may be used with any construction of a surface cleaning apparatus. Alternately, it may be used in a surface cleaning apparatus having interchangeable components and/or operating components on a top of a collection chamber.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative of the invention and non-limiting and it will be understood by persons skilled in the art that other variants and modifications may be made without departing from the scope of the invention as defined in the claims appended hereto.

The invention claimed is:

1. A surface cleaning apparatus comprising (a) a member having a dirty fluid inlet;

(b) a fluid flow path extending from the dirty fluid inlet to a clean air outlet of the surface cleaning apparatus and including a suction motor;

(c) at least one cyclone positioned in the fluid flow path and having at least one material outlet; and, (d) a reconfigurable divider plate associated with the material outlet, the divider plate being reconfiqurable by at least one of the following:

i. the divider plate is replaceable with an alternate divider plate;

ii. the divider plate has a configuration that is variable;

iii. the divider plate has a portion that is removable;

iv. the divider plate has a portion that is movable to an alternate in use position; and, v. the divider plate is moveable with respect to a separated material outlet of the cyclone to an alternate in use position.

2. The surface cleaning apparatus of claim 1 wherein the divider plate is replaceable with an alternate divider plate.

3. The surface cleaning apparatus of claim 1 wherein the divider plate has a configuration that is variable.

4. The surface cleaning apparatus of claim 3 wherein the configuration of the divider plate is variable from a planar configuration to a bow shaped configuration.

5. The surface cleaning apparatus of claim 1 wherein the divider plate has a portion that is removable.

6. The surface cleaning apparatus of claim 5 wherein the removable portion comprises a central section of the divider plate.

7. The surface cleaning apparatus of claim 1 wherein the divider plate has a portion that is movable to an alternate in use position.

8. The surface cleaning apparatus of claim 7 wherein the movable portion comprises a central section of the divider plate.

9. The surface cleaning apparatus of claim 1 wherein the divider plate is moveable with respect to a separated material outlet of the cyclone to an alternate in use position.

10. The surface cleaning apparatus of claim 9 wherein the divider plate is moveable towards the separated material outlet.

11. The surface cleaning apparatus of claim 9 wherein the divider plate is moveable laterally with respect to the separated material outlet.

* * * * *